US010968024B2

(12) United States Patent
Palumbo

(10) Patent No.: US 10,968,024 B2
(45) Date of Patent: Apr. 6, 2021

(54) TRAY, PACKAGE, APPARATUS AND PROCESS OF MAKING SAID TRAY AND SAID PACKAGE

(71) Applicant: CRYOVAC, INC., Charlotte, NC (US)

(72) Inventor: Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 25 days.

(21) Appl. No.: 16/070,371

(22) PCT Filed: Feb. 28, 2017

(86) PCT No.: PCT/IB2017/051173
§ 371 (c)(1),
(2) Date: Jul. 16, 2018

(87) PCT Pub. No.: WO2017/149458
PCT Pub. Date: Sep. 8, 2017

(65) Prior Publication Data

US 2019/0023474 A1 Jan. 24, 2019

(30) Foreign Application Priority Data

Mar. 1, 2016 (IT) ..... 102016000021651

(51) Int. Cl.
*B65D 71/08* (2006.01)
*B65D 81/20* (2006.01)
(Continued)

(52) U.S. Cl.
CPC ..... *B65D 81/2015* (2013.01); *B65B 5/02* (2013.01); *B65B 7/2878* (2013.01); *B65B 11/52* (2013.01);
(Continued)

(58) Field of Classification Search
CPC . B65D 1/26; B65D 1/34; B65D 5/241; B65D 81/2015; B65D 81/2038; B65B 11/52; B65B 31/028
(Continued)

(56) References Cited

U.S. PATENT DOCUMENTS 3,054,505 A * 9/1962 Hennessey ..... B65D 5/5007 206/216
3,153,505 A * 10/1964 Bessett ..... B65D 75/305 229/125.26
(Continued)

FOREIGN PATENT DOCUMENTS

CN 1331040 A 1/2002
DE 20 2012 013306 U1 2/2016
WO 2014180823 A1 11/2014

*Primary Examiner* — Luan K Bui
(74) *Attorney, Agent, or Firm* — Jon M. Isaacson

(57) ABSTRACT

A tray for containing a product includes a base, a lateral wall emerging from the base to define a containing seat adapted to receive the product. The lateral wall comprises at least one movable portion configurable between a first stable position, wherein the movable portion is placed in continuity with respect to the lateral wall, and a second stable position, wherein the movable portion protrudes from the lateral wall and defines an access passing through the lateral wall itself. Moreover, the present invention refers to a process and an associated apparatus of making said tray. Further, the present invention refers to a vacuum package using the above described tray and to a plastic film sealingly applied on the tray and closing the access, and also to a process and a packaging apparatus for making said package.

10 Claims, 22 Drawing Sheets

(51) Int. Cl.

| | |
|---|---|
| ***B65D 75/30*** | (2006.01) |
| ***B65B 31/02*** | (2006.01) |
| ***B65B 5/02*** | (2006.01) |
| ***B65B 7/28*** | (2006.01) |
| ***B65B 11/52*** | (2006.01) |
| ***B65D 1/26*** | (2006.01) |
| ***B65D 5/24*** | (2006.01) |

(52) U.S. Cl.
CPC ..... *B65B 31/028* (2013.01); *B65D 1/26* (2013.01); *B65D 5/241* (2013.01); *B65D 75/305* (2013.01); *B65D 81/2038* (2013.01)

(58) Field of Classification Search
USPC ..... 206/497, 557, 524.8; 53/427; 220/231, 220/659; 229/120, 407
See application file for complete search history.

(56) References Cited

U.S. PATENT DOCUMENTS

| | | | | | |
|---|---|---|---|---|---|
| 3,521,810 | A * | 7/1970 | Boyer | B65D 5/38 | 229/101 |
| 4,236,664 | A * | 12/1980 | Hartelmuller | B65D 5/0065 | 229/191 |
| 4,469,273 | A * | 9/1984 | Smith | B65D 5/68 | 229/117.03 |
| 2005/0074531 | A1 | 4/2005 | Patterson | | |
| 2006/0269707 | A1 * | 11/2006 | Berbert | B65D 75/5855 | 428/35.7 |
| 2008/0128584 | A1 * | 6/2008 | Zuffi | A47J 37/01 | 249/134 |
| 2011/0068042 | A1 * | 3/2011 | Palumbo | B65B 11/52 | 206/557 |
| 2016/0194101 | A1 | 7/2016 | Palumbo | | |
| 2016/0340098 | A1 * | 11/2016 | Palumbo | B65B 31/025 | |

* cited by examiner

FIG.1
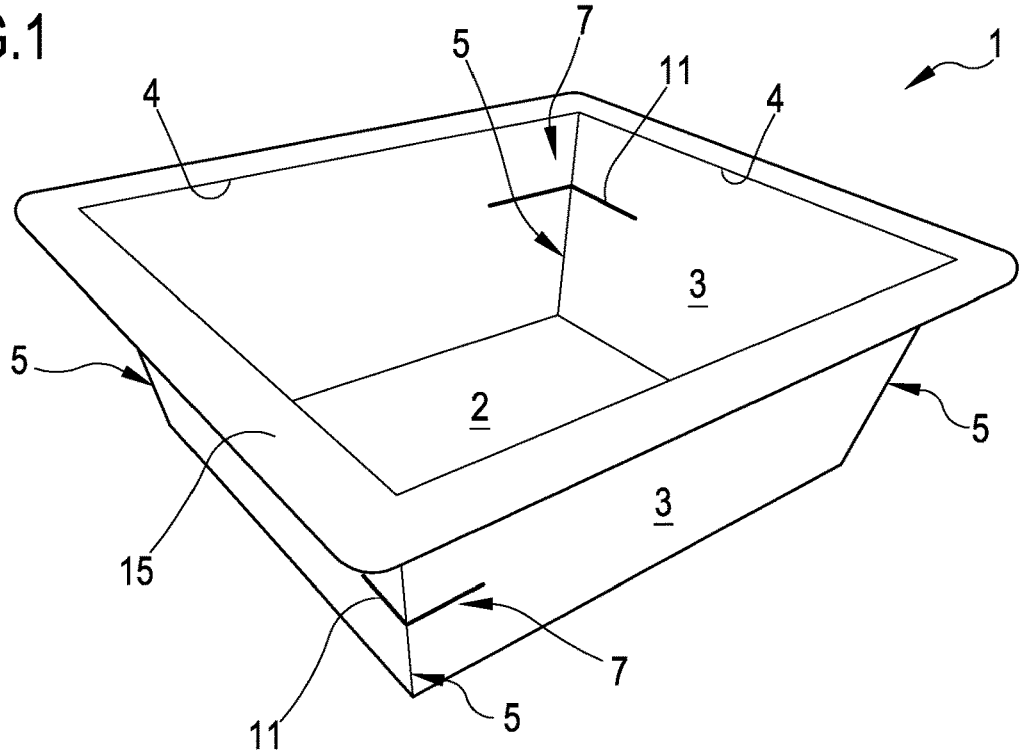
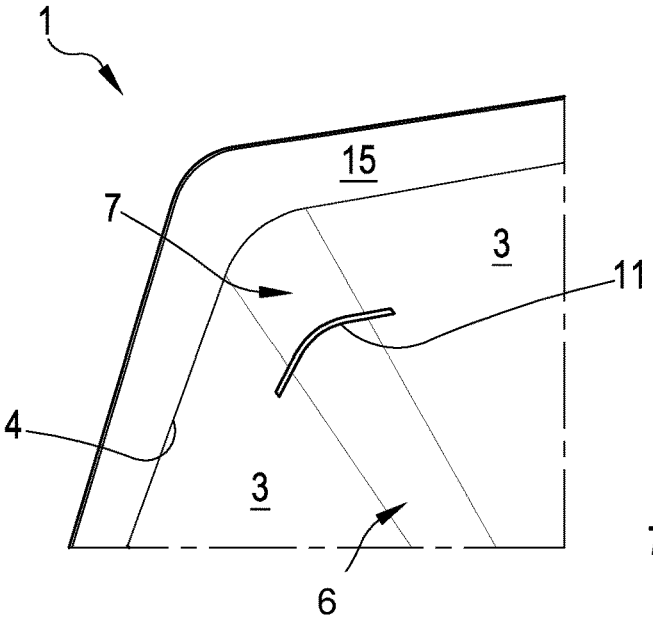
FIG.1A
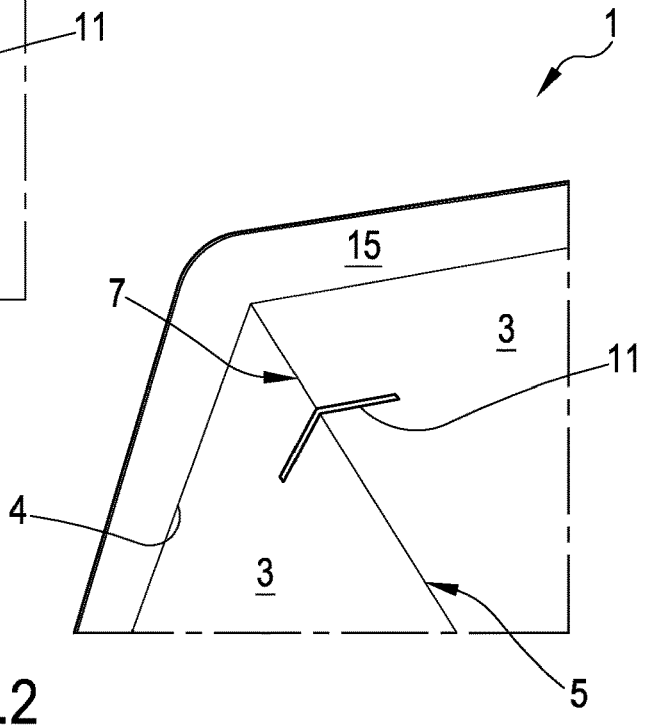
FIG.2

FIG.15
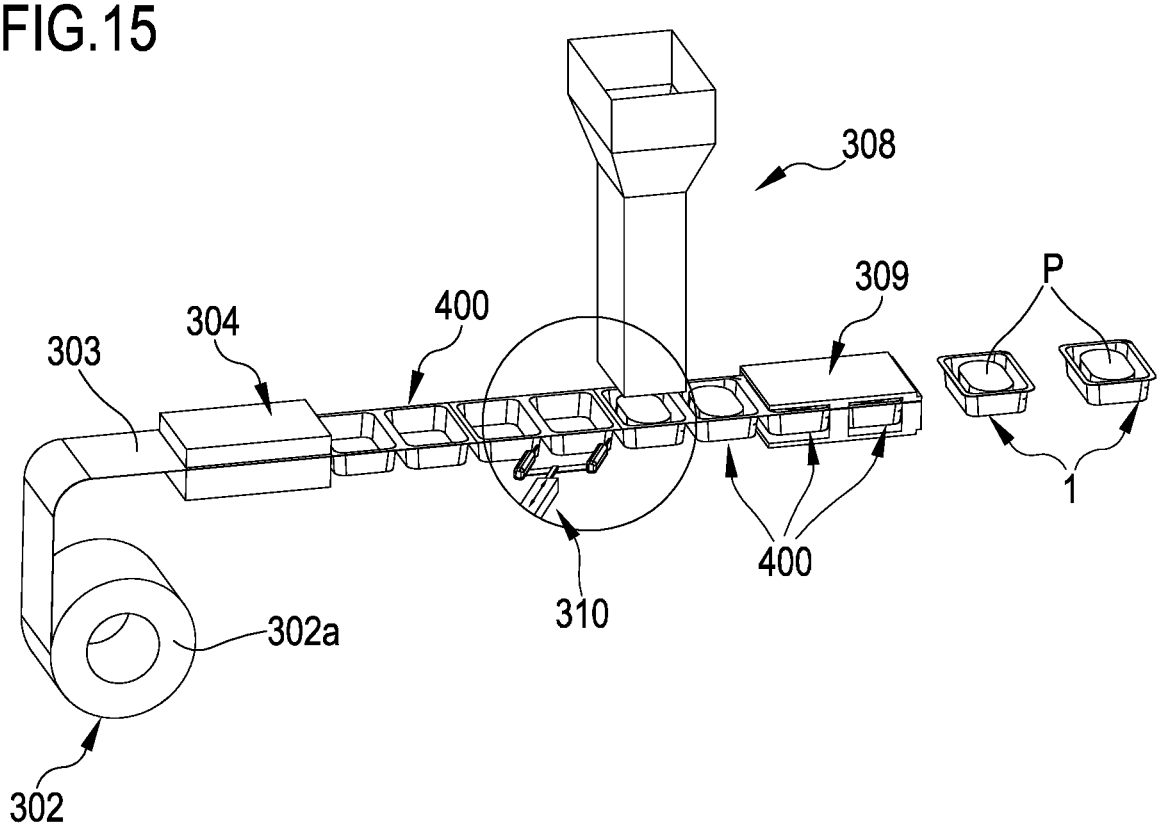
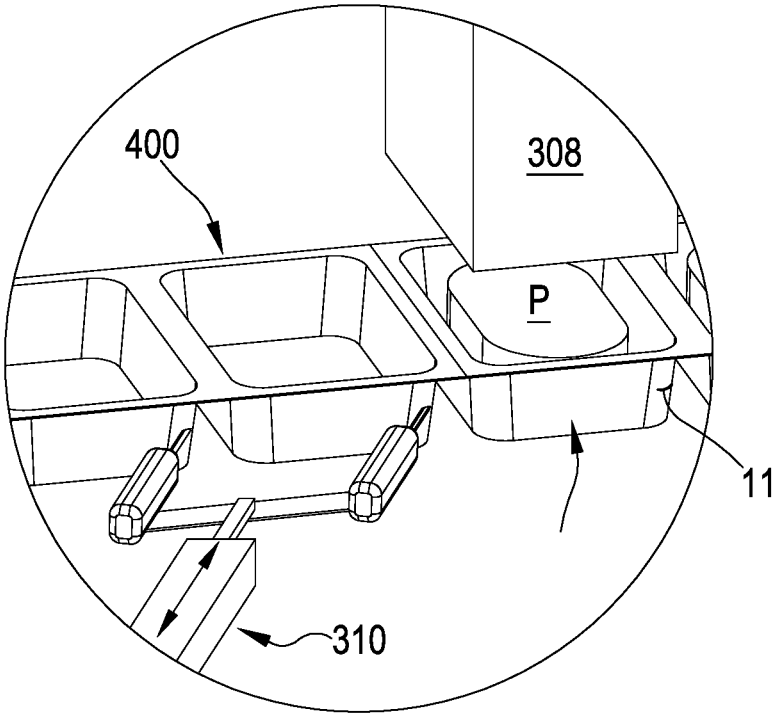
FIG.16

FIG.20A
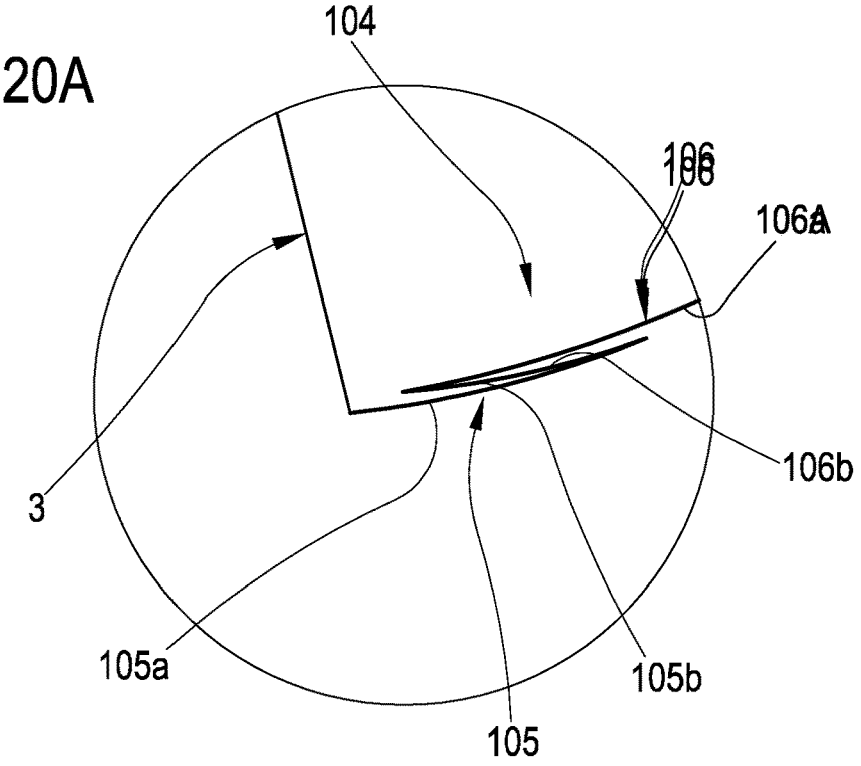
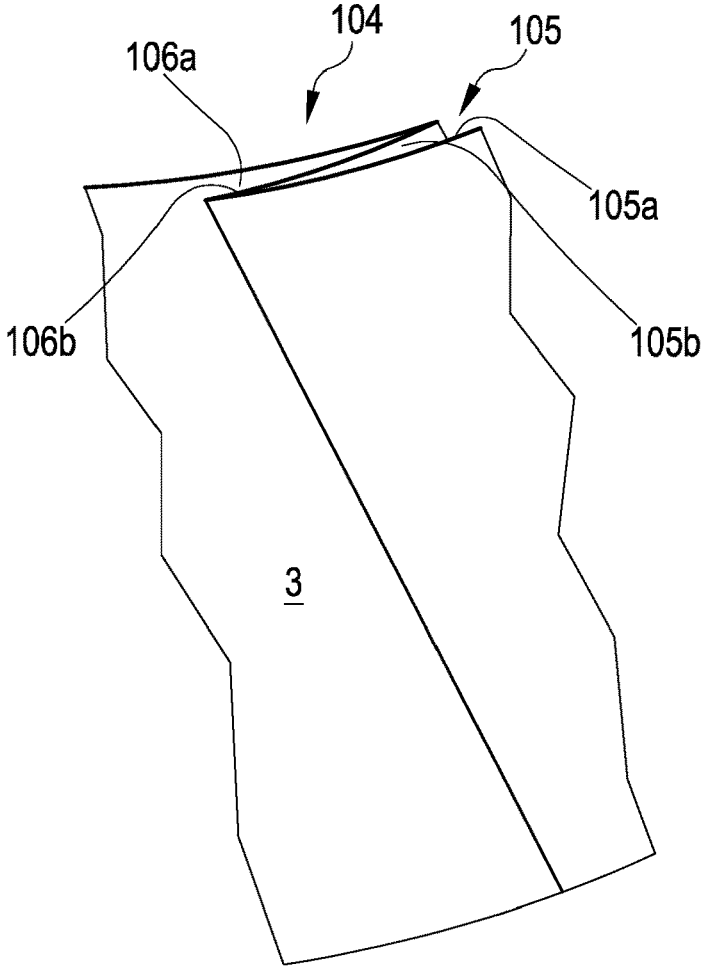
FIG.20B

TRAY, PACKAGE, APPARATUS AND PROCESS OF MAKING SAID TRAY AND SAID PACKAGE

FIELD OF THE INVENTION

The present invention refers to a tray and an associated package, particularly for containing food-type products. Moreover, the invention refers to a process and an associated apparatus for making said tray and said package.

STATE OF THE ART

Apparatuses and associated methods of vacuum packaging products are known in the packaging field. Among the packaging processes, processes making packages by plastic film for vacuum closing foods, such as for example meat and fish to be frozen, cheese, treated meats, ready meals and similar foods are known. This type of vacuum packages closed by plastic films is described, for example, in the following patent documents: FR1258357, FR1286018, AU3491504, USRE30009, U.S. Pat. Nos. 3,574,642, 3,681,092, 3,713,849, 4,055,672 and 5,346,735.

The vacuum packaging process is substantially a thermoforming process comprising: the provision of a product (food) inside a rigid or semi-rigid support, for example, defined by a tray, a bowl, or a cup of plastic material. The support and the associated product are disposed inside a vacuum chamber. Inside the chamber, a thermoplastic film is welded to an upper edge of the support; then, the air present inside the package, is extracted so that the thermoplastic film can adhere to the product disposed inside the support.

Some examples of machines and associated processes of vacuum packaging products are described in the following.

The U.S. Pat. No. 3,481,101 describes a method of making a package comprising a square base tray provided with lateral walls—with a substantially vertical development, emerging from the base—and upper edge portions emerging from the lateral walls outwardly directed with respect to the tray. The tray is provided with a plurality of closed outline openings defined on the upper edge portions and/or at the tray lateral walls. The method comprises: positioning a product inside the tray and then sealingly closing the same by a heated film. After positioning the film, the method comprises applying a vacuum inside the package through the plurality of openings so that the film conforms to the product placed inside the tray and then defines the sealing of the same.

The solution described in the U.S. Pat. No. 3,481,101 comprises removing air from the inside of the supporting tray by closed outline through openings disposed on a portion of the upper edge of the tray, or at the lateral flat surfaces. However, such configuration of the tray enables to extract only a small quantity of air; the film—adhering to the product due to the applied vacuum—immediately occludes the openings so that the desired quantity of air cannot be extracted. Such problem is particularly felt in case of extremely deep trays; in such cases, true and actual air pockets of substantial size are formed inside the package.

An excessive amount of air in the packages can deteriorate the food and adversely affect the use-by-date of the product itself. It is also noted that the presence of air pockets can negatively affect the appearance of the package, and therefore how the consumer perceives the package.

Document No. EP320294 describes a packaging process comprising the provision of a tray containing one or more products; the tray is provided with one or more vent openings in a lateral wall. A film projecting from the upper edge is laid above the tray; the film is then heated and vacuum is applied through the lateral opening of the tray for stretching the film to conform it to the surface of the product. Then, the excess film is cut.

The packaging process described in the application No. EP0320294 enables to remove a greater amount of air than the above described U.S. patent thanks to the excess material provided for the film, and thanks to the step of preheating the same. Although such solution is an improvement with reference to the air removed from the inside of the package, the process and therefore the product obtained by it are somewhat expensive. Actually, the method requires the use of an excessive quantity of a closing film and performing an additional step of heating the film.

Further examples of trays provided with preexistent holes are known from documents U.S. Pat. No. 4,919,955, WO9714313 and US2005074531. The holes present on the trays described in documents U.S. Pat. No. 4,919,955 and US2005074531 are further provided with valve means.

A further example—described in the patent application No. EP2722279 in the name of the same Applicant—provides a process and an associated apparatus for packaging under vacuum products disposed on a perforated support.

OBJECT OF THE INVENTION

A first object of the invention consists of providing a tray and an associated package capable of ensuring to efficiently extract air from the package itself without compromising the structure and therefore the function thereof.

A further object of the present invention consists of providing a tray and an associated package which are easily and readily manufacturable and particularly obtainable at a reasonable manufacturing cost.

Then, it is an object of the present invention to provide an apparatus and packaging process capable of removing a suitable amount of air from the package without compromising the structurality of the package and without adversely compromising the overall costs of the final product.

Moreover, it is an object of the invention to provide a process and packaging apparatus implementable without requiring elaborate modifications to the standard packaging systems.

Another auxiliary object consists of providing an apparatus and packaging process capable of safely operating and particularly capable to obtain the object of removing air without compromising the appearance of the packaged final product.

One or more of the above described objects, which will better appear in the following description, are substantially met by a tray, a package and an apparatus and process of making the same according to one or more of the attached claims.

SUMMARY

The aspects of the invention are described in the following.

In a 1st aspect, it is provided a tray (1) for containing a product (P), for example a food-type product (P), said tray (1) comprising:

a base (2), a lateral wall (3) transversally emerging from the base (2) to define a containing seat adapted to receive the product (P), the lateral wall (3) being delimited by a free edge (4) opposite to the base (2) and defining an opening of the tray (1), the lateral wall (3) comprising at least one movable, optionally foldable portion (7) configurable between:

at least one first stable position, wherein the movable portion (7) is optionally placed in continuity with respect to the lateral wall (3), and at least one second stable position, wherein said movable portion (7) protrudes from the lateral wall (3) and defines an access (8) passing through the lateral wall (3) itself.

In a 2nd aspect according to the aspect 1, the lateral wall (3) comprises one or more of:

an angular portion (5) exhibiting a concavity facing the containing seat of the tray (1), a curved portion (6) exhibiting a concavity facing the containing seat of the tray (1), said movable portion (7) being defined at the angular portion (5) and/or the curved portion (6).

In a 3rd aspect according to the preceding aspect, the movable portion (7) is configurable between:

the first stable position wherein the foldable portion (7) is placed in continuity with the angular portion (5) and/or curved portion (6) of the lateral wall (3), particularly the foldable portion (7) in the first stable portion does not protrude from the angular portion (5) and/or curved portion (6) of the lateral wall (3), the second stable position wherein said movable portion (7) protrudes from said angular portion (5) and/or curved portion (6) of the lateral wall (3) inside the containing seat of the tray (1).

In a 4th aspect according to the aspect 2 or 3, the movable portion (7) is a foldable portion (7) configurable between:

the first stable position, wherein the foldable portion (7) is placed in continuity with the angular portion (5) and/or curved portion (6) of the lateral wall (3), particularly the foldable portion (7) in the first stable portion does not protrude from the angular portion (5) and/or curved portion (6) of the lateral wall (3), the second stable position wherein said foldable portion (7) protrudes from said angular portion (5) and/or curved portion (6) of the lateral wall (3) inside the containing seat of the tray (1).

In a 5th aspect according to anyone of the preceding aspects, the movable portion (7) is defined at least one non-flat surface of the lateral wall (3) of the tray (1).

In a 6th aspect according to anyone of the preceding aspects, the movable portion (7), in the second stable position and cooperatively with the lateral wall (3) defines at least one access (7) passing through the lateral wall (3) itself.

In a 7th aspect according to the preceding aspect, the access (8) is interposed between the base (2) and free edge (4) of the lateral wall (3).

In an 8th aspect according to anyone of the preceding aspects, the access (8) is delimited by at least one free edge (13) of the movable portion (7) and by at least one intermediate edge (14) of the lateral wall (3).

In a 9th aspect according to the preceding aspect, the lateral wall (3) comprises, at said angular portion (5) and/or curved portion (6), at least one cut (11) or weakening line (12) configured for promoting the formation—in the second stable position of the movable portion (7)—of the free edge (13) of the movable portion (7) and of the intermediate edge (14) of the lateral wall (3).

In a 10th aspect according to anyone of the preceding aspects, the movable portion (7) comprises at least one tab (9) hinged to the lateral wall (3) by at least one folding line (10), said tab (9) being rotatively movable with respect to the lateral wall (3) about said folding line (10).

In an 11th aspect according to anyone of the preceding aspects, the movable portion (7) is integrally joined to the lateral wall (3) of the tray (1).

In a 12th aspect according to anyone of the preceding aspects, the lateral wall (3) exhibits, along a cross-section of the wall itself, a polygonal shape, the lateral wall (3) comprising a plurality of angular portions (5), the lateral wall (3) comprising at least one movable portion, optionally a foldable portion (7), defined at at least one angular portion (5).

In a 13th aspect according to anyone of the preceding aspects, the movable portion (7), optionally the foldable portion (7), comprises a first tab (9*a*) connected to one side of the angular portion (5) by means of a first folding line (10*a*), the movable portion (7), optionally the foldable portion (7), further comprising a second tab (9*b*) connected to another side of the angular portion (5) itself by a second folding line (10*b*).

In a 14th aspect according to the preceding aspect, said first and second tabs (9*a*, 9*b*) being connected to each other by an intermediate folding line (10*c*).

In a 15th aspect according to anyone of the aspects from 12 to 14, the movable portion (7) in the first stable position, defines, along a cross-section, a substantially "L" or "V" shape, the concavity thereof faces the containing seat of the tray (1), the movable portion (7), in the second stable position, defining, along a cross-section, a substantially "L" or "V" shape, the concavity thereof faces away from the containing seat of the tray (1).

In a 16th aspect according to the aspect 14 or 15, the first folding line (10*a*), second folding line (10*b*) and intermediate folding line (10*c*) intersect each other in a point of a corner of the angular portion (5) itself, optionally wherein the movable portion (7), particularly the foldable portion (7), exhibits a cross-section with a size increasing from said intersection point of the folding lines (10*a*, 10*b*, 10*c*).

In a 17th aspect according to anyone of the preceding aspects, the tray comprises two movable portions (7), optionally two foldable portions (7), disposed opposite to each other with respect to the base (2) of the tray (1).

In an 18th aspect according to anyone of the preceding aspects, the tray comprises a flange (15), placed at the opening defined in the lateral wall (3), transversally emerging from the lateral wall (3) away from the containing seat, the base (2), lateral wall (3) and flange (15) of the tray being made in a single piece.

In a 19th aspect according to anyone of the preceding aspects, the base (2) and lateral wall (3) are integrally made in order to form a single solid body.

In a 20th aspect according to anyone of the preceding aspects, the tray (1) is made by deforming a single flat sheet of paper material, said sheet, after a deforming step, being disposed in a three-dimensional configuration for defining said tray (1).

In a 21st aspect according to anyone of the aspects from 1 to 19, the tray (1) is made by thermoforming a flat sheet of plastic material, said sheet, after the deforming step by thermoforming, being arranged in a three-dimensional configuration for defining said tray (1).

In a 22nd aspect according to anyone of the preceding aspects, the tray comprises at least one main layer made of at least one material selected in the group of the following materials: paper, paperboard, plastics.

In a 23rd aspect according to the preceding aspect, wherein the tray (1) comprises at least one auxiliary layer coupled to the main layer facing the containing seat of the tray, and made of a plastic material.

In a 24th aspect, it is provided a process for making a tray (1,) according to anyone of the preceding aspects, said process comprising the following steps:

providing a sheet with a flat configuration, deforming said sheet for defining at least the base (2) and lateral wall (3) of the tray (1), making at least said movable portion (7).

In a 25th aspect according to the preceding aspect, the step of making the movable portion (7) provides to make, at the angular portion (5) and/or curved portion (6) of the tray (1), a cut (11) or a weakening line (12) developing along a plane transversal to the development surface of the lateral wall (3), optionally the cut (11) or weakening line (12) develops along a plane substantially parallel to a development plane of the base (2) of the tray (1).

In a 26th aspect according to the aspect 24 or 25 for making a tray (1) according to the aspect 20 or 22, the process comprising at least a step of cutting the sheet for defining a flat semifinished product (101), said semifinished product (101) comprising at least one central element (102) and at least one perimetral element (103) disposed around the central element (102).

In a 27th aspect according to the preceding aspect, the deforming step comprises deforming the semifinished product (101) for folding the perimetral element (103) with respect to the central element (102) for defining a plurality of folding areas (104), the step of deforming the semifinished product (101) defining the lateral wall (3) of the tray (1) wherein each folding area (104) defines the angular portion (5) or curved portion (6) of the lateral wall (3) of the tray 1.

In a 28th aspect according to the preceding aspect, each folding area (104) comprising a first and second overlapping zones (105, 106), the first overlapping zone (105) comprising at least one first and one second portions (105*a*, 105*b*) of a first surface of the semifinished product (101) facing and in contact with each other, the second overlapping zone (106) comprising at least one first and one second portions (106*a*, 106*b*) of a second surface of the semifinished product, facing and in contact with each other, the step of deforming the semifinished product (101) defining the lateral wall (3) of the tray (1) wherein each folding area (104) defines the angular portion (5) or curved portion (6) of the lateral wall (3).

In a 29th aspect according to the aspect 26 or 27 or 28, the process comprises a step of working the semifinished product (101) during which a cut (107) and/or a weakening line (108) are made on the perimetral element (103), said cut (107) and weakening line (108) of the semifinished product (101) being respectively configured for defining the cut (11) or weakening line (12) of the tray (1).

In a 30th aspect according to anyone of the aspects from 26 to 29, the central element (102) has a polygonal shape, the perimetral element (103) exhibiting:

a lateral portion (103*a*) emerging from each perimetral side of the central element (102), each lateral portion (103*a*) emerging away from the central element (102) and being distanced from the further lateral portions (103*a*), a plurality of connecting portions (103*b*) emerging away from the central element (102) and connecting two lateral portions (103*a*) consecutively disposed around said central element (102), each connecting portion (103*b*) being configured for defining—after the deforming step—the folding area (104).

In a 31st aspect according to the preceding aspect, the cut (107) or weakening line (108) of the semifinished product (101) is made on at least one connecting portion (103*b*) of the perimetral element (103), particularly each cut (107) or weakening line (108) is made on at least one connecting portion (103*b*) and in continuity on the lateral portion (103*a*) immediately after said connecting portion (103*b*), said cut (107) and weakening line (108) being respectively configured for defining the cut (11) and weakening line (12) of the tray (1).

In a 32nd aspect according to anyone of the aspects from 26 to 31, the process comprises at least the following steps:

providing on at least one first development surface of the flat sheet, a film of plastic material, cutting the sheet for defining the flat semifinished product (101) delimited by an external perimeter, deforming the semifinished product (101) for defining at least the base (2) and lateral wall (3) of the tray (1), after the deforming step said film of plastic material coats the containing seat of the tray In a 33rd aspect according to anyone of the aspects from 27 to 32, the process comprises at least the following steps:

providing on a first and second development surfaces of the sheet, a film of plastic material, cutting the sheet for defining the semifinished product (101), deforming the semifinished product (101) for defining at least the base (2) and lateral wall (3) of the tray (1), after the deforming step said film of plastic material coating an internal and external surface of the tray (1), heating the semifinished product (101) during the step of deforming the same so that the film of plastic material can stably constrain to each other:

the first and second portions (105*a*, 105*b*) of the first surface of the semifinished product, and the first and second portions (106*a*, 106*b*) of the second surface of the semifinished product.

In a 34th aspect according to anyone of the aspects from 26 to 31, the process comprises at least the following steps:

deforming the semifinished product (101) of paper material for defining at least the base (2) and lateral wall (3) of the tray (1), providing inside the tray (1) a coating adapted to cover at least part of the internal surface of the tray (1) itself, particularly the coating completely covers the base (2) and lateral wall (3) of the tray (1).

In a 35th aspect according to the preceding aspect, wherein the step of providing the coating at the internal surface of the tray (1) comprises a step of thermoforming said coating inside the tray (1).

In a 36th aspect according to the aspect 34 or 35, wherein the step of providing the coating at the internal surface of the tray (1) comprises at least the following sub-steps:

moving at least one tray (1) of paper material inside a vacuum station configured for defining a fluid-tight chamber, moving at least a portion of a coating of plastic material into the vacuum station, holding said film portion above the tray, tightly closing the vacuum station, heating the coating portion of plastic material, generating inside the vacuum station a pressure less than the atmospheric pressure, releasing the coating portion so that the portion itself—the negative pressure condition generated between the coating portion and the tray—can adhere to the paper material and therefore form a multi-layer comprising the paper material and the coating or coatings of plastic material.

In a 37th aspect according to anyone of the aspects from 34 to 36, the process—after the step of applying the coating of plastic material to the internal surface of the tray of paper material—comprises at least a step of making, at the angular portion (5) and/or curved portion (6) of the tray (1), a cut (11) or weakening line (12) developing along a plane transversal to the development surface of the lateral wall (3), optionally the cut (11) or weakening line (12) develops along a plane substantially parallel to a development plane of the base (2) of the tray (1), the cut (11) and weakening line being configured for defining the movable portion (7) of the tray (1).

In a 38th aspect according to the aspect 24 or 25, the process comprises the following steps:

providing a sheet at least partially of plastic material with a flat configuration, thermoforming the flat sheet in order to define the base (2) and lateral wall (3) of the tray (1), optionally, cutting the deformed sheet for defining a single tray (1), after the deforming step, particularly before the cutting step, making, at the angular portion (5) and/or curved portion (6) of the tray (1), a cut (11) or weakening line (12) developing along a plane transversal to the development surface of the lateral wall (3), optionally the cut (11) or weakening line (12) develops along a plane substantially parallel to a development plane of the base (2) of the tray (1), the cut (11) and weakening line being configured for defining the movable portion (7) of the tray (1).

In a 39th aspect, it is provided a package (200) comprising:

at least one tray (1) according to anyone of the aspects from 1 to 23, or made according to the process according to anyone of the aspects from 24 to 38, at least one product (P), optionally of a food-type, housed in the containing seat of the tray (1), at least one plastic film (201) having a first portion preferably contacting the product (P), and a second portion fluid-tightly engaged with an internal surface of the lateral wall (3) of the tray (1) not contacting said product, said film (201) cooperatively with said tray (1) defining a fluid-tight closed volume, inside which said product (P) is housed.

In a 40th aspect according to the preceding aspect, the plastic film (201) completely covers the movable portion (7), particularly the foldable portion (7) of the tray (1).

In a 41st aspect according to the aspect 39 or 40, the plastic film (201) is configured for defining around the movable portion (7), particularly around the foldable portion (7), a fluid-tight closure.

In a 42nd aspect according to anyone of the aspects from 39 to 41, the second portion, fluid-tightly engaged with an internal surface of the lateral wall (3) of the tray (1) not contacting said product (P), forms a sealing band completely surrounding the product and tightly insulating the product from the movable portion (7), and particularly from the access (8) defined by the movable portion (7).

In a 43rd aspect according to anyone of the aspects from 39 to 42, the plastic film is tightly fixed to the most part, optionally at least 80%, of the internal surface of the lateral wall of the tray not contacting the product (P) and also to the upper surface of the flange of the tray.

In a 44th aspect according to anyone of the aspects from 39 to 43, the movable portion (7) of the tray (1) is disposed in the first stable position.

In a 45th aspect, it is provided a packaging process comprising the following steps:

providing a predetermined number of trays (1), each of said trays being of a type according to anyone of the aspects from 1 to 23, or being made according to the process anyone of the aspects from 24 to 38, placing one or more products (P) to be packaged in each of said trays (1), moving at least one tray (1) with the associated product (P) into a packaging station (203), tightly closing the packaging station (203) in order to define a fluid-tight chamber wherein said tray (1) is housed, said tray (1) exhibiting at least one foldable portion (7) disposed in the second stable position, removing at least part of the air inside the fluid-tight chamber in order to define inside the same a pressure less than the atmospheric pressure, the air present in the tray (1) being removed through the access (8) defined by the movable portion (7) in the second stable position.

In a 46th aspect according to the preceding aspect, the process comprises at least one step of heat coupling, in the packaging station (203), at least one portion (204*a*) of a film (204) to said tray (1), optionally to at least said flange of the tray, after the heat-coupling step, the process provides to continuously remove the air present between the tray (1) and portion (204*a*) of the film, through the access (8).

In a 47th aspect according to the aspect 45 or 46, the process comprises at least the following steps:

holding said film portion above the respective tray, heating said film portion held above the respective tray, following or simultaneously with the step of removing the air present between the tray (1) and the film portion (204*a*) through the access (8), releasing said film portion previously held above the respective tray in order to arrange the film portion (204*a*) for tightly closing the product and for tightly enveloping the movable portion (7) of the tray for defining at least one package (200), moving the package (200) outside the packaging station (203).

In a 48th aspect according to anyone of the aspects from 45 to 47, the process comprises a step of handling the tray (1), outside or inside the packaging station (203), during which, the movable portion (7) is moved from the first to the second stable positions.

In a 49th aspect according to the preceding aspect, the handling step comprises at least the following sub-steps:

withdrawing a tray (1) and positioning it in the packaging station (203), after positioning the tray (1) in the packaging station (203), thrustingly acting, by a pusher (206), on an angular portion (5) and/or on a curved portion (6) of the tray, for displacing the movable portion (7) from the first to the second stable positions, and wherein the pusher (206) is placed inside the packaging station (203) and particularly inside the fluid-tight chamber, the pusher (206) comprising:

at least one solid body configured for displacing the movable portion from the first to the second stable positions, and particularly making the cut (11) or weakening line (12) of the tray (1), and/or at least one tubular body configured for displacing the movable portion from the first to the second stable positions, and removing air from the containing seat of the tray, particularly said pusher being further configured for making the cut (11) or weakening line (12) of the tray (1).

In a 50th aspect according to anyone of the aspects from 45 to 49, the process comprises the following steps:

unwinding a continuous film (204) from a reel (205), transversally cutting the continuous film, outside the packaging station (203), for defining the portion (204*a*) of the film (204) which exhibits a size sufficient to cover at least the free edge (4) of the tray (1), moving the film portion (204*a*) into the packaging station (203), engaging the portion (204*a*) inside the packaging station (203) with an upper tool (207) of the station itself, positioning the tray (1) and the associated product (P) on a lower tool (208) inside the packaging station (203), approaching to each other the upper tool supporting said film portion and lower tool housing said tray, for defining said fluid-tight chamber.

In a 51st aspect according to anyone of the aspects from 45 to 50, the process comprises the following steps:

unwinding a continuous film (204) from a reel (205), moving a film portion into the packaging station (203), engaging a film portion inside the packaging station (203) with an upper tool (207) of the station itself, positioning the tray (1) and the associated product (P) on a lower tool (208) inside the packaging station (203), cutting inside the packaging station, the film portion (204*a*) for separating said portion from the continuous film, after or before cutting the film portion, approaching to each other the upper tool supporting said film portion, and lower tool housing said tray, for defining said fluid-tight chamber.

In a 52nd aspect according to the aspect 50 or 51, the process comprises the following steps:

after engaging the film portion with the upper tool (207), heating said film portion (204*a*), after or during the step of heating the film portion (204*a*), placing such film portion (204*a*) in contact with at least one portion of the lateral wall (3) of the tray (1) and optionally with the flange (15).

In a 53rd aspect according to the preceding aspect, wherein the step of contacting the film portion with the lateral wall of the tray comprises the following sub-steps:

approaching the heated film portion to the tray (1) so that the portion itself is at least partially in contact with the free edge (4) of the tray (1), disengaging said film portion from the upper tool for causing the film portion to engage the tray and cover the product, simultaneously and/or after engaging the film portion with the tray, removing by the access of the movable portion, the air present between the tray and film portion engaged with the tray itself.

In a 54th aspect, it is provided an apparatus (500) for packaging a product (P) disposed on a tray (1) according to anyone of the aspects from 1 to 23, the apparatus (500) being optionally configured for performing the packaging process according to the aspects from 45 to 53, said apparatus (500) comprising:

a frame, a conveyor (209) engaged with the frame and configured for moving one or more trays (1) along a predetermined advancement direction (A), a supplying group (202) configured for supplying a film, a packaging station (203) configured for receiving one or more of said trays (1) housing one or more products (P), and at least one portion (204*a*) of said film, said packaging station (203) comprising:

a lower tool (208) configured for receiving one or more trays (1), an upper tool (207) having a heater of the film portion (204*a*), and at least one holding system configured for holding the film portion (204*a*) above one or more of said trays (1), and an air suctioning system (213) configured for removing air from the interior of the packaging station (203) itself, wherein the upper and lower tools are movable from each other between at least one spaced condition, at which the lower and upper tools enable to admit in the packaging station (203), a film—or a portion of the film—and the tray (1), and at least one closing approached condition, at which the lower and upper tools define a fluid-tight chamber, said apparatus further comprising at least one pusher (206), active on the tray, for moving at least one movable portion (7), particularly the foldable portion (7), of the tray (1) in the second stable position, and wherein the packaging apparatus (500) further comprises a control unit (600) connected to the packaging station (203) and configured for:

commanding the pusher (206) for determining the passage of the movable portion (7) to the second stable position, commanding the movement of the upper and lower tools for approaching each other for defining the closing approached condition, commanding to heat the upper tool for heating the film portion (204*a*) engaged on the tool itself, commanding the suctioning system to remove at least part the air present inside the fluid-tight chamber, in order to define inside the same a pressure less than the atmospheric pressure.

In a 55th aspect according to the preceding aspect, the pusher (206) comprises:

at least one head portion configured for contacting the movable portion (7) of the tray (1), at least one actuator connected to the head portion and configured for moving the pusher between a retracted position wherein the pusher head is spaced from the tray (1), and an advanced position wherein the head is at least partially in contact with the movable portion (7) of the tray (1), the actuator is configured for moving the head between the retracted position to the advanced one for enabling to move the movable portion between the first and second stable positions, and wherein the control unit (600) is connected to the conveyor (209) and the actuator of the pusher (206), said control unit (600) being configured for:

commanding the movement of the conveyor (209) so that the trays (1) abutting on the same, are moved at a predetermined speed along the advancement direction (A), commanding the actuator of the pusher (206) for reciprocally moving the head between the retracted position and the advanced one, synchronizing the reciprocal movement of the pusher between the retracted position and the advanced one as a function of at least one of the following parameters:

the predetermined movement speed of the trays (1), imparted by the conveyor (209) along the advancement direction (A), a predetermined film supplying speed, the relative position between the lower tool and the upper tool, an active condition of the suctioning system wherein the same enables to remove at least part of the air present inside the fluid-tight chamber of the packaging station, an active condition of the upper tool wherein the same heats the film portion (204*a*) engaged on the tool itself.

In a 56th aspect according to the aspect 54 or 55, the pusher (206) is disposed at least in one among the following operative positions:

upstream the conveyor (209), the pusher (206) comprising a system for handling the trays, configured for raising and positioning the trays on the conveyor (209), at the conveyor (209), the pusher (206) is configured for operating on the trays abutting and sliding on the conveyor (209), inside the packaging station (203), the pusher (206) is configured for operating on the trays (1) engaged with the lower tool (208) of the packaging station (203).

In a 57th aspect according to the aspect 55 or 56, the head portion of the pusher (206) comprises at least one of:

a solid body, a tubular body exhibiting a through seat connected to the suctioning system of the packaging station (203).

In a 58th aspect according to anyone of the aspects from 55 to 57, the pusher (206) is engaged inside the packaging station (203), and wherein the control unit (600) is configured for:

commanding the distanced condition of the packaging station, wherein the lower and upper tools are distanced from each other, optionally, commanding the retracted position of the pusher, commanding the movement of the conveyor (209) for enabling to insert at least one tray in the packaging station (203), after inserting the tray (1) in the packaging station (203), commanding the movement of the pusher from the retracted position to the approached one for enabling to move the movable portion (7) of the tray (1) from the first to the second stable positions, commanding the movement of the upper and lower tools towards each other for defining the closed approached condition, commanding the suctioning system to remove at least part of the air present inside the fluid-tight chamber for defining inside the same a pressure less than the atmospheric one.

In a 59th aspect according to anyone of the aspects from 54 to 58, the upper tool (207) of the packaging station comprises a holding system configured for stably engaging the film portion (204*a*), and wherein the control unit (600) is configured for:

commanding the movement of the upper and lower tools away from each other for defining the distanced condition, commanding the insertion into the packaging station (203) of at least one film portion, commanding the insertion into the packaging station (203) of at least one tray, commanding the activation of the system holding the upper tool configured for engaging at least one film portion, commanding the movement of the upper and lower tools towards each other for defining the closed approached condition, after defining the closed approached condition of the packaging station (203), commanding the heating of the upper tool for heating the film portion (204*a*) engaged on the tool itself, commanding the suctioning system to remove at least part of the air present inside the fluid-tight chamber for defining inside the same a pressure less than the atmospheric one, commanding the holding system to release the heated film portion (204*a*) above the respective tray in order to arrange the film portion (204*a*) to tightly close the product and to be tightly closed around the movable portion (7) of the tray for defining at least one package (200).

In a 60th aspect according to the preceding aspect, wherein the control unit (600) is further configured for:

after heating the film portion (204*a*), commanding to approach the heated film portion (204*a*) to the tray (1) so that the portion itself is at least partially in contact with the free edge (4) of the tray (1), after approaching the film portion (204*a*) and tray to each other, commanding the holding system of the packaging station (203) to release said film portion from the upper tool in order to cause the engagement of the heated film portion to the tray and to cover the product (P), synchronizing the activation of the suctioning system so that the same can simultaneously and/or after engaging the film portion to the tray—remove by the access (8) of the movable portion (7), the air present between the tray (1) and film portion engaged with the same tray.

BRIEF DESCRIPTION OF THE DRAWINGS

Some embodiments and some aspects of the invention will be described in the following with reference to the attached drawings, given in an illustrative and therefore non-limiting way, wherein:

FIG. 1 is a perspective view of a tray according to present invention;

FIG. 1A is a perspective view of an embodiment variant of a tray according to the present invention;

Figure 9:
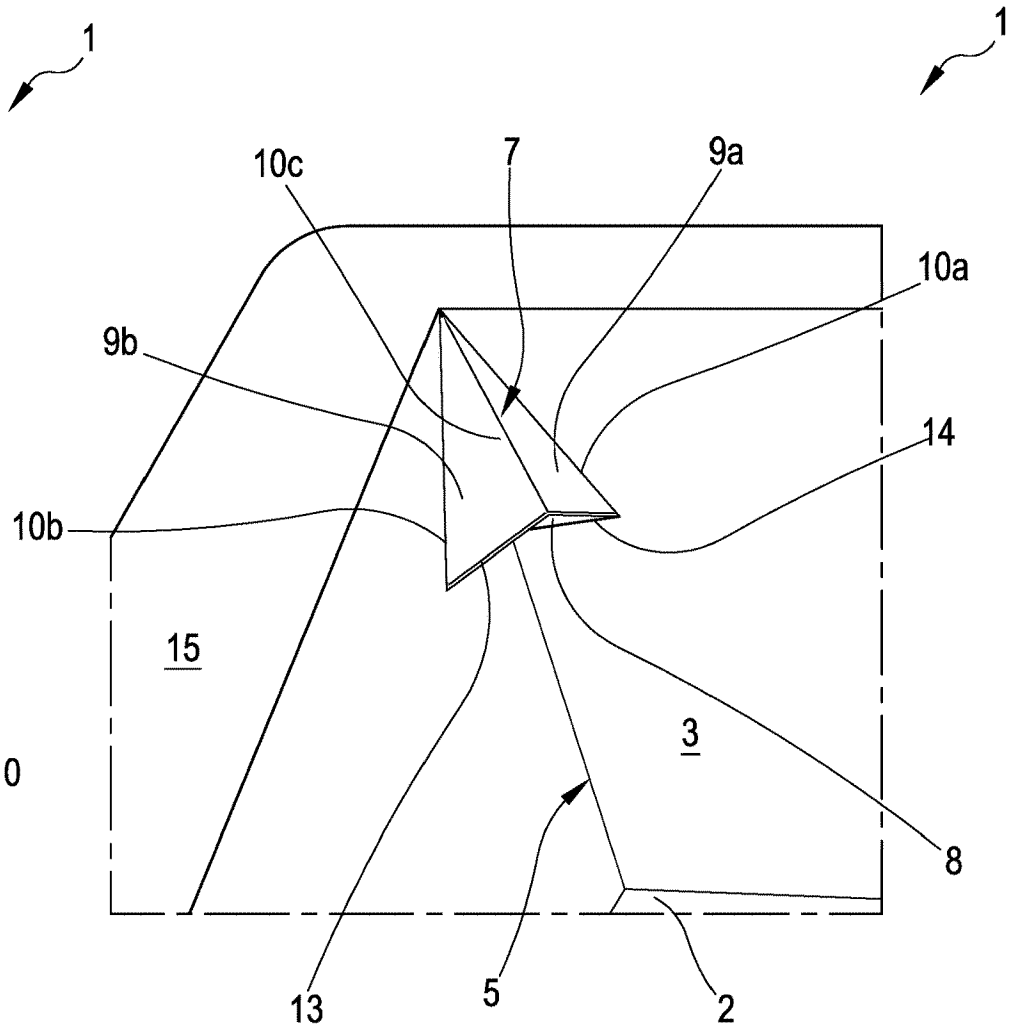
Figure 8:
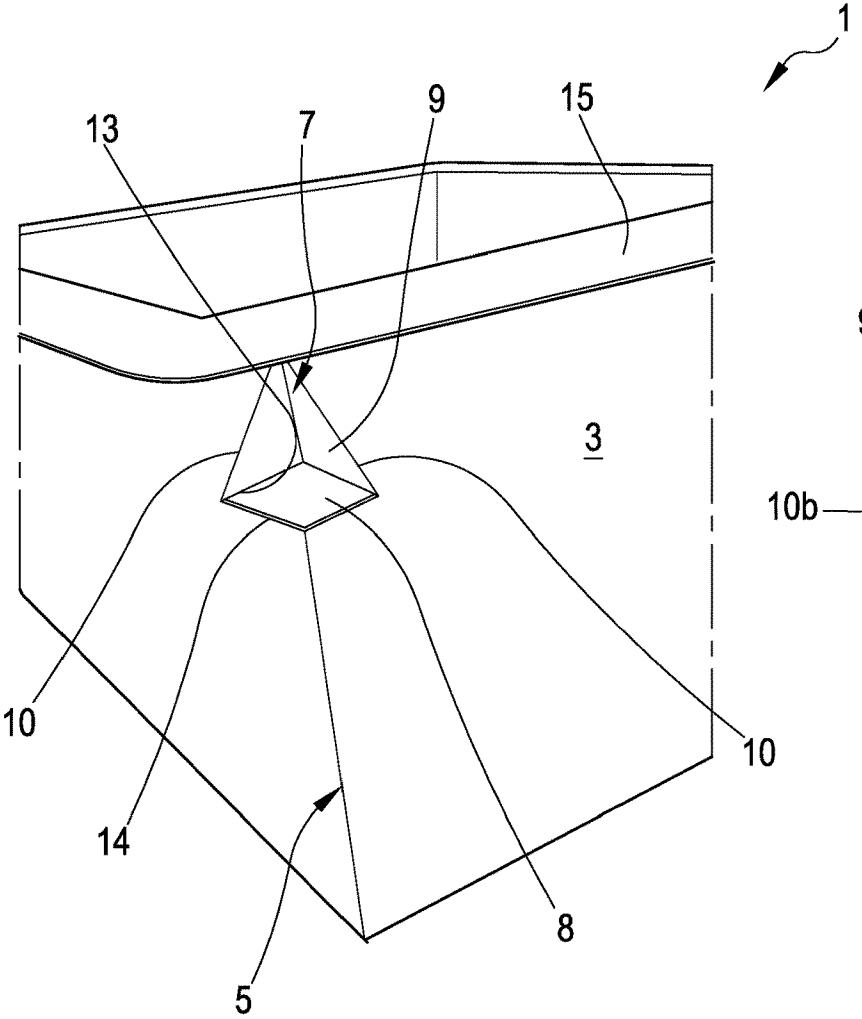
Figure 10:
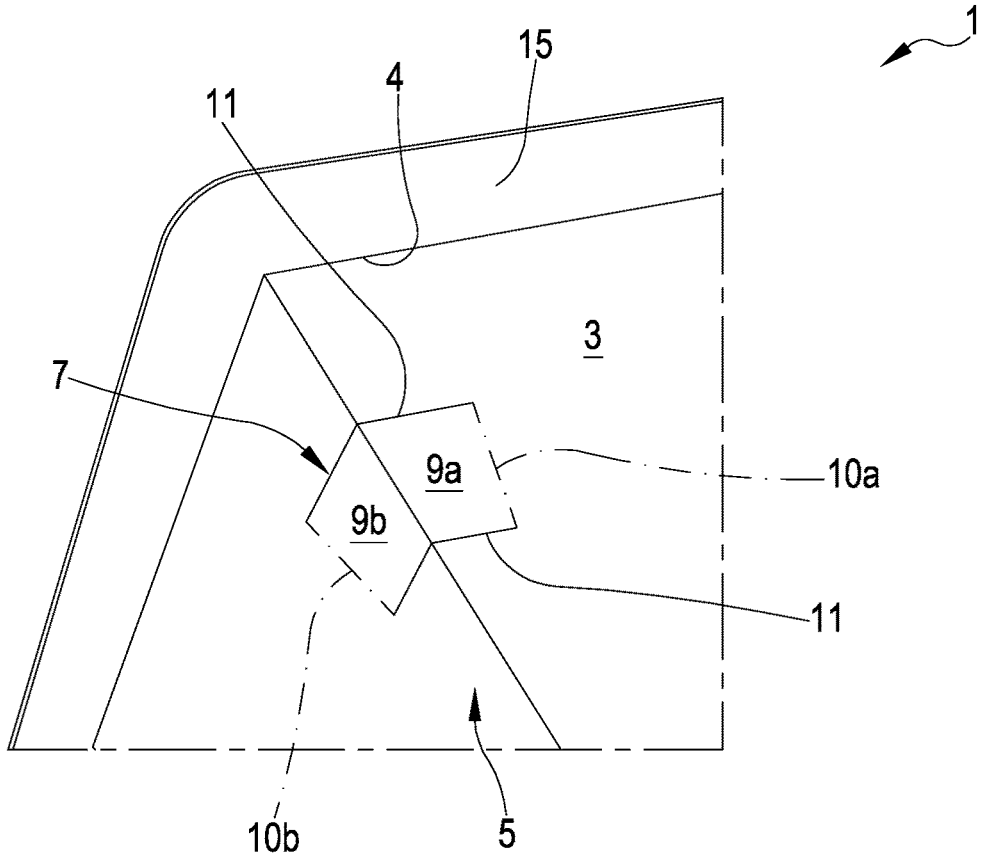
Figure 11:
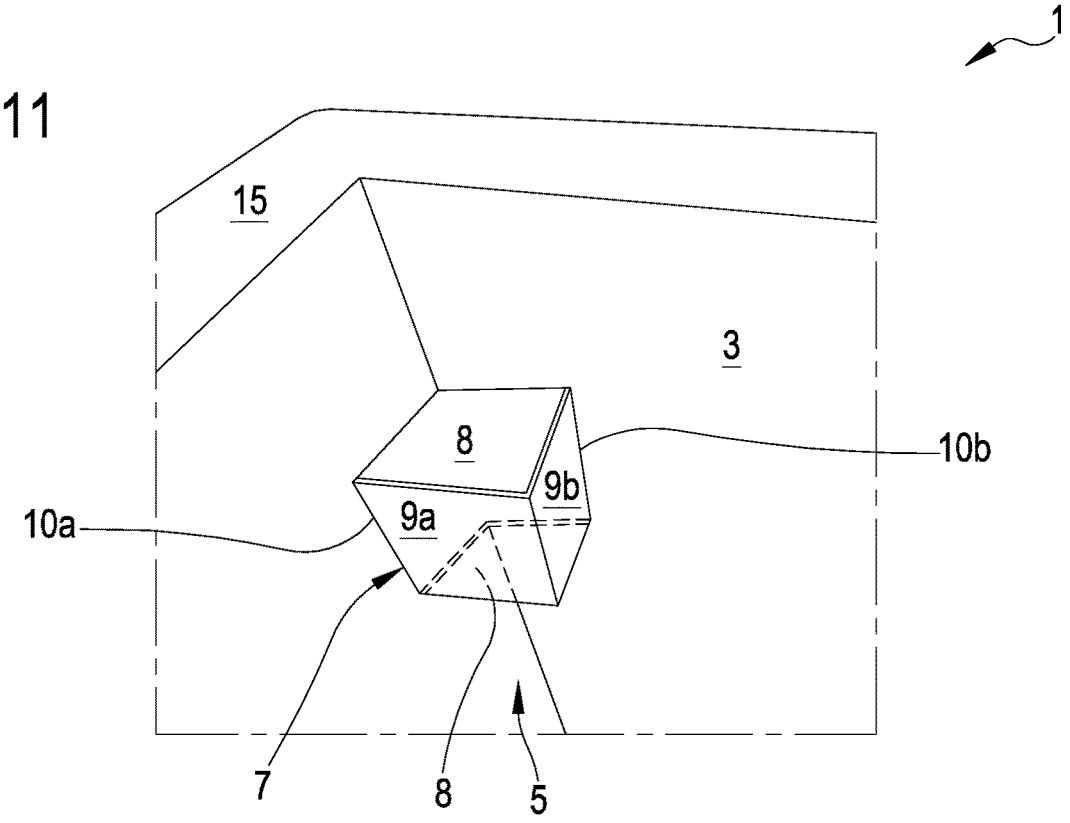
Figure 12:
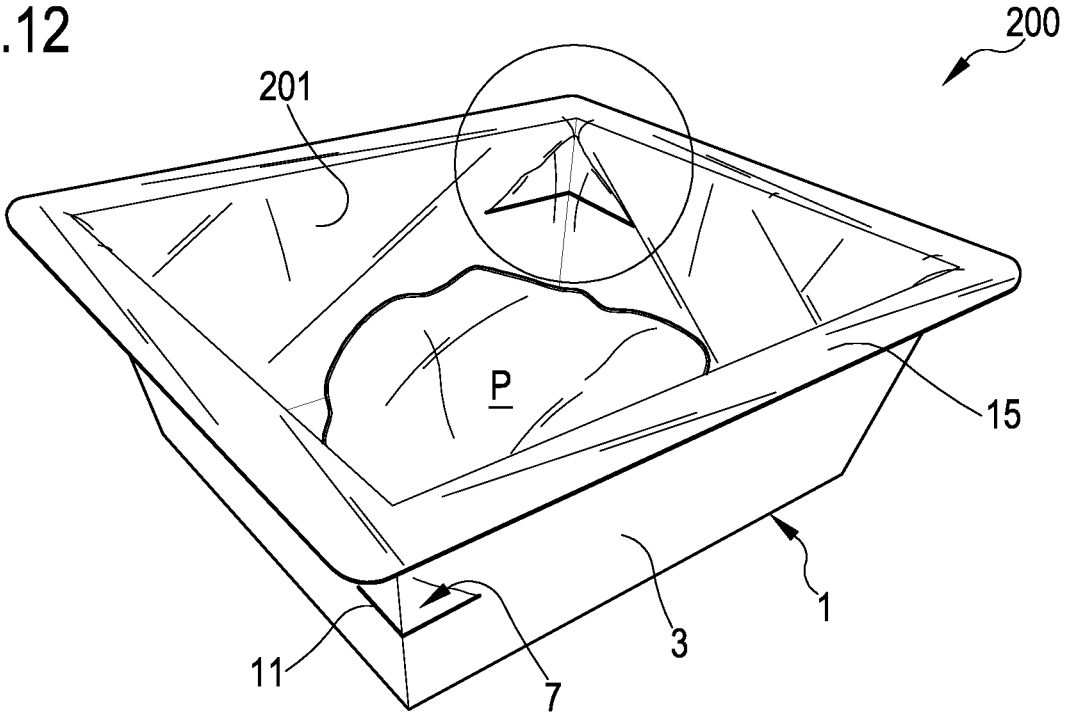
Figure 13:
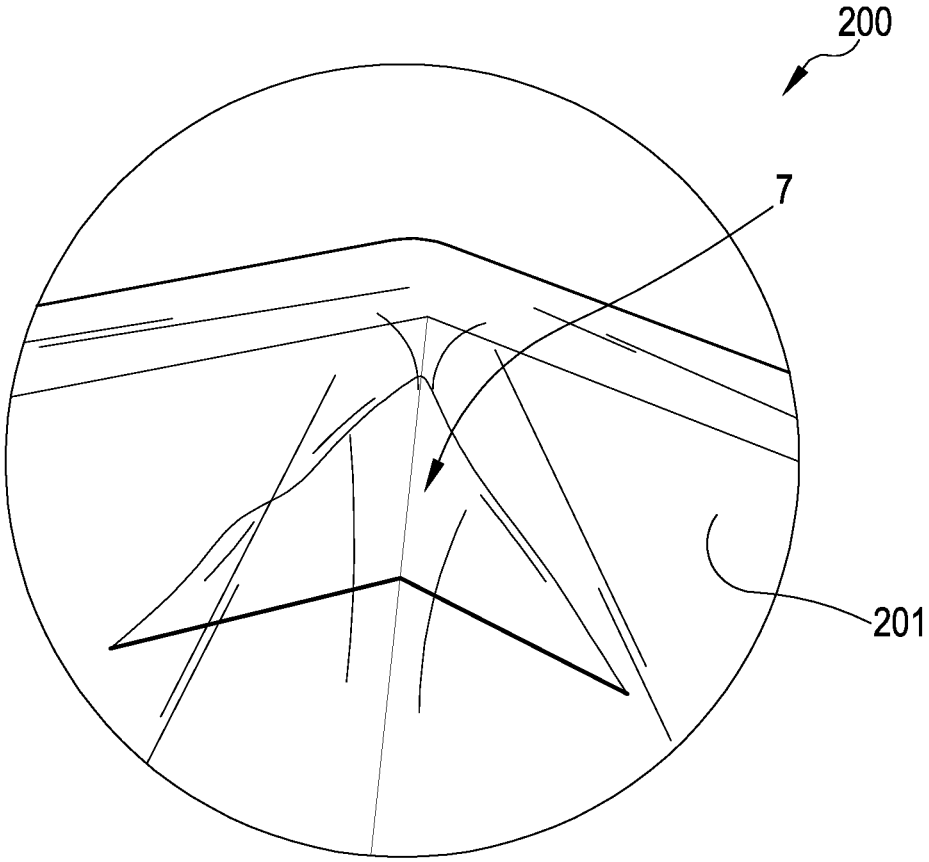
Figure 14:
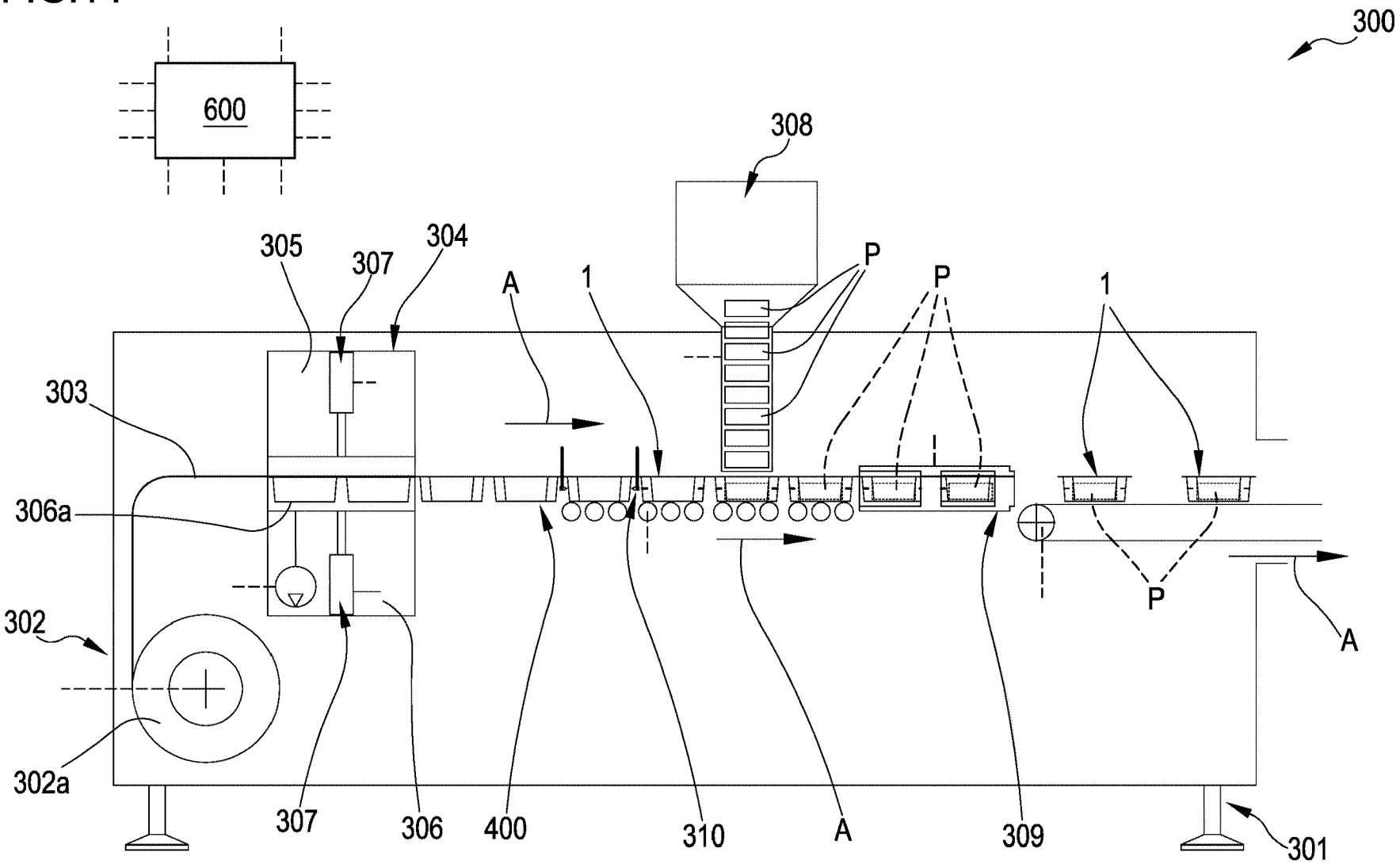
Figure 18:
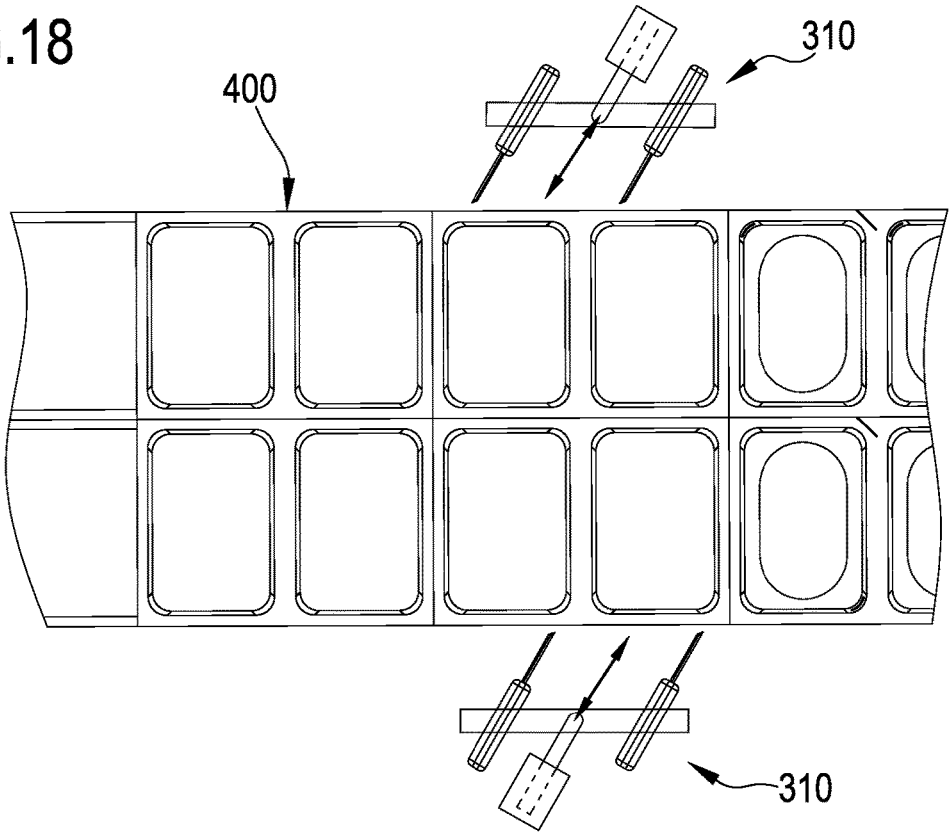
Figure 19:
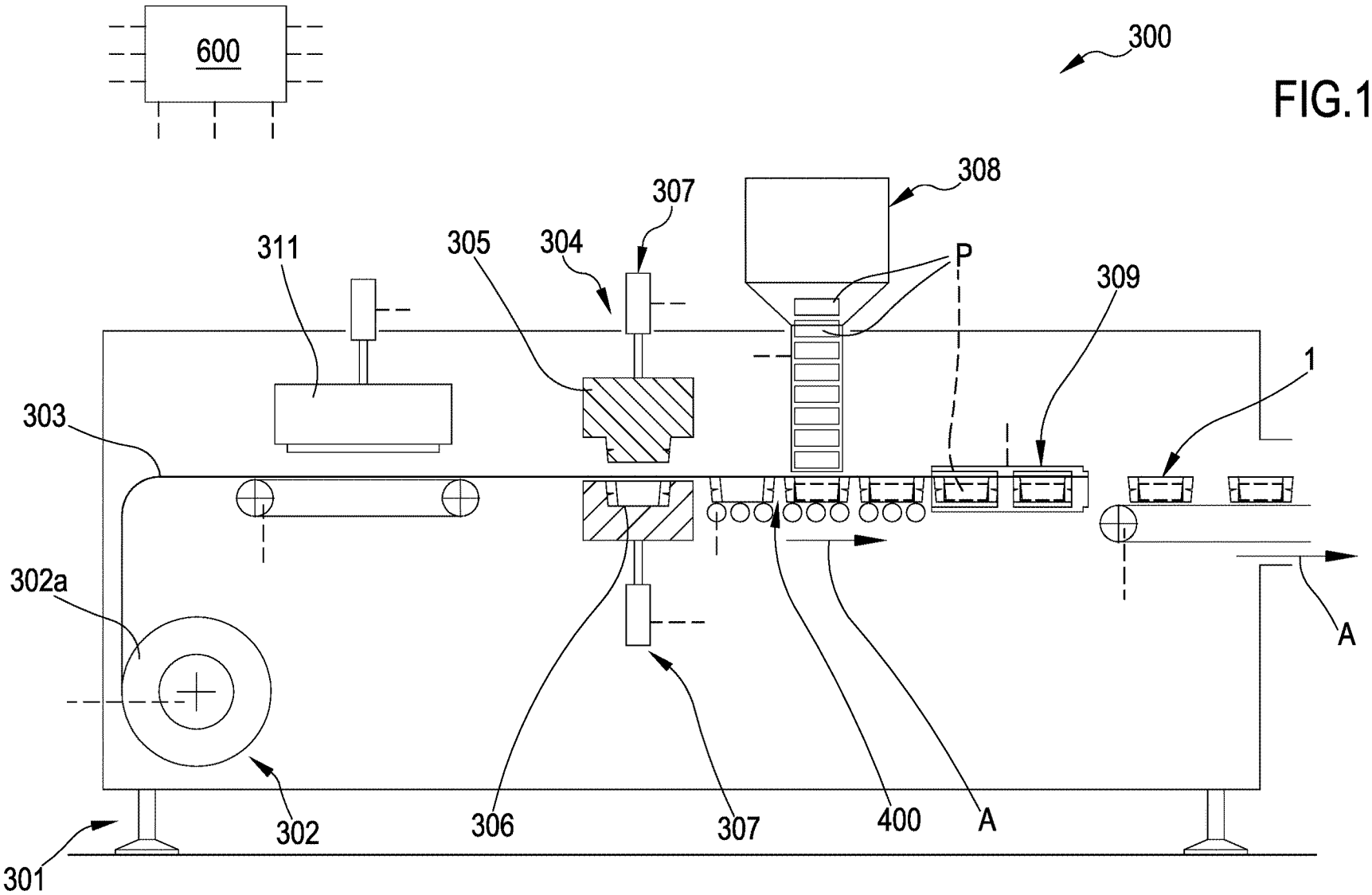
Figure 20:
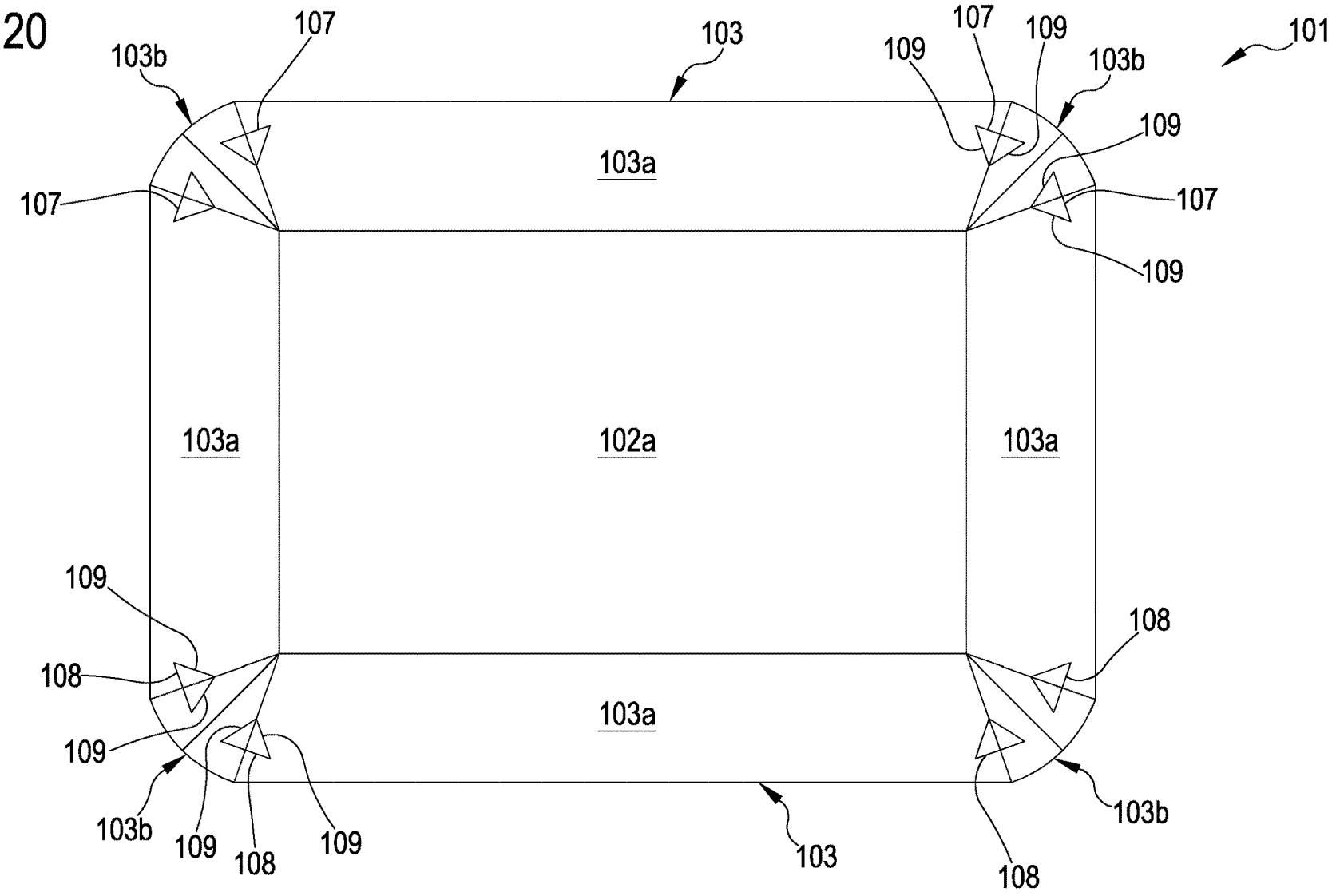
Figure 21:
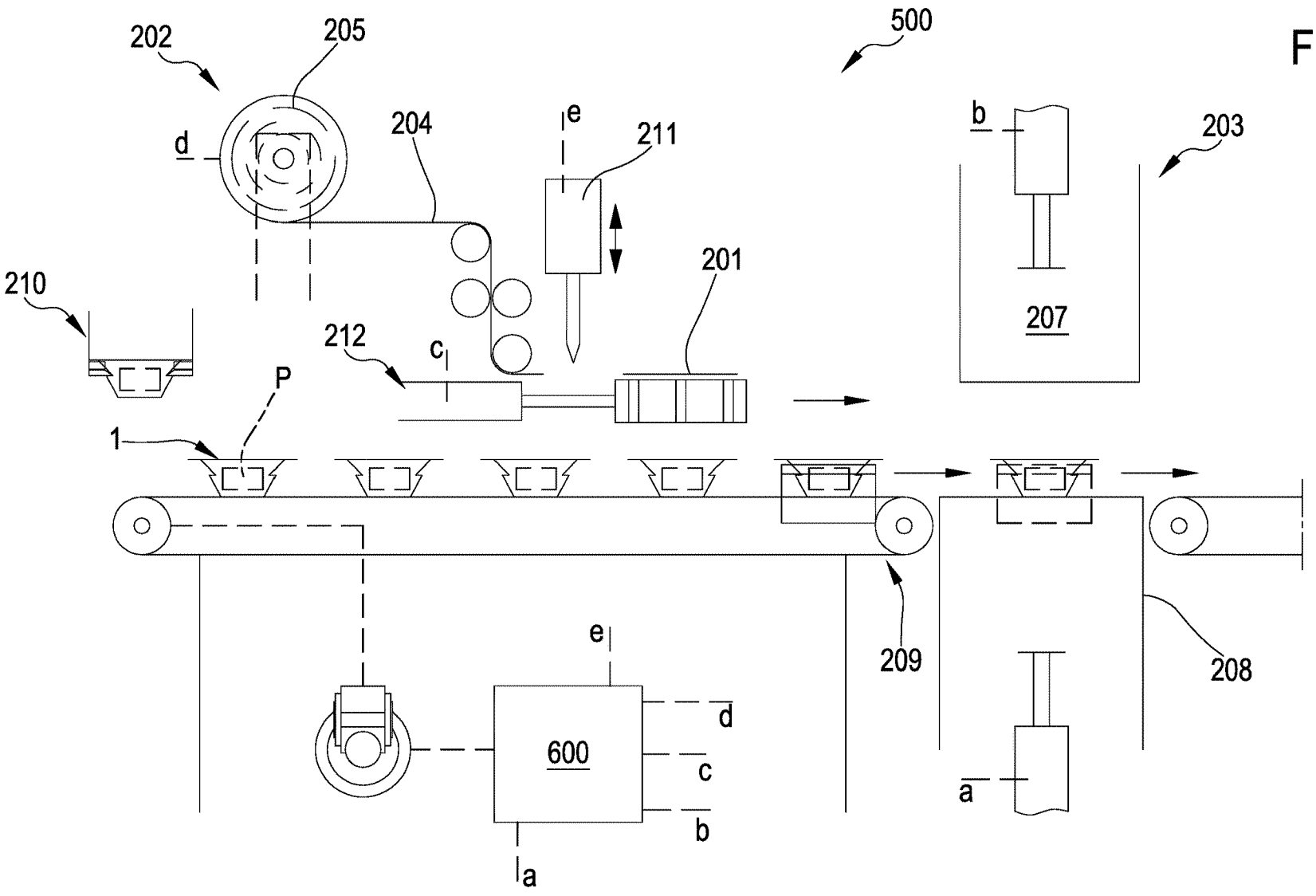
Figure 22:
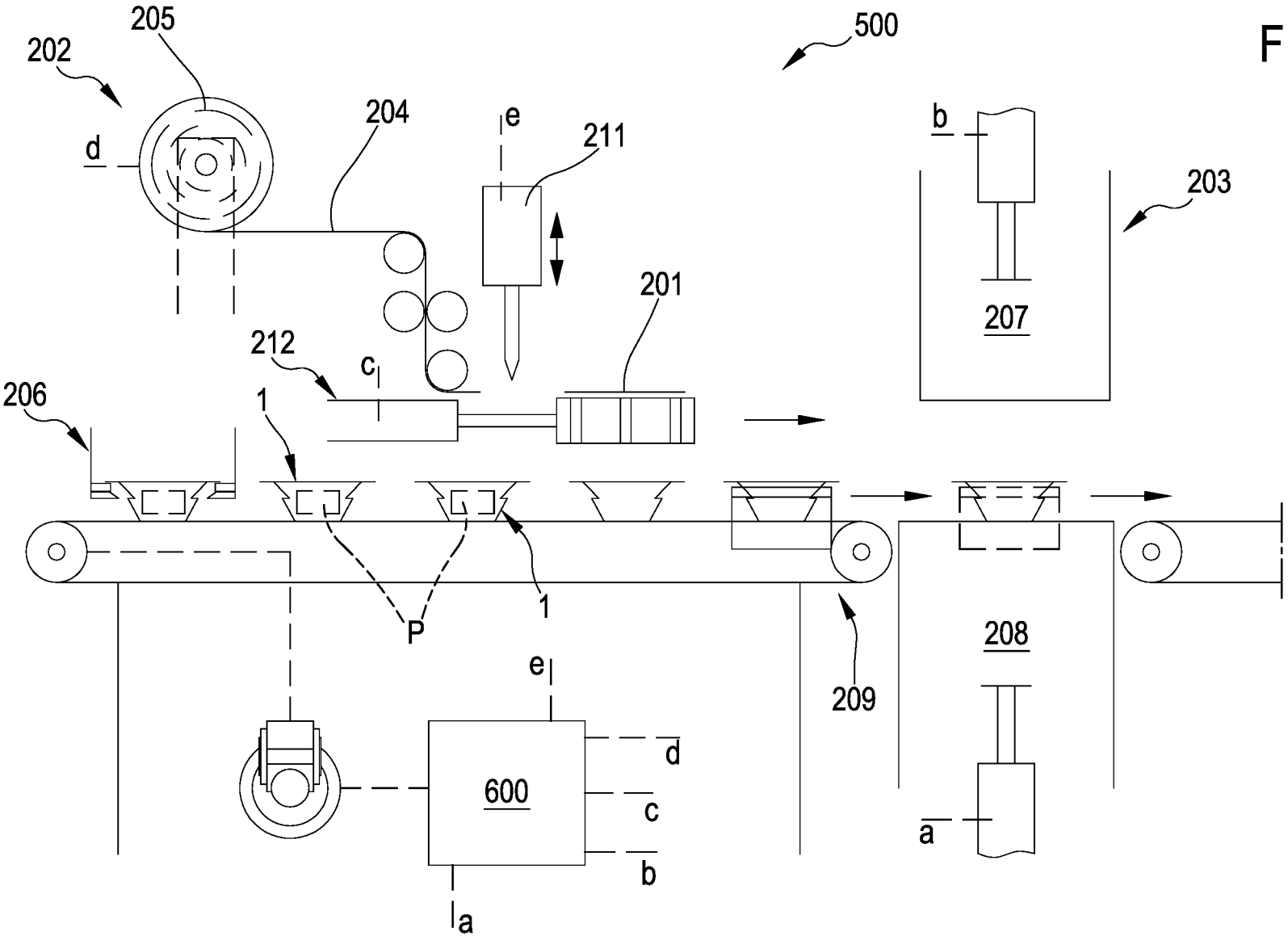
Figure 23:
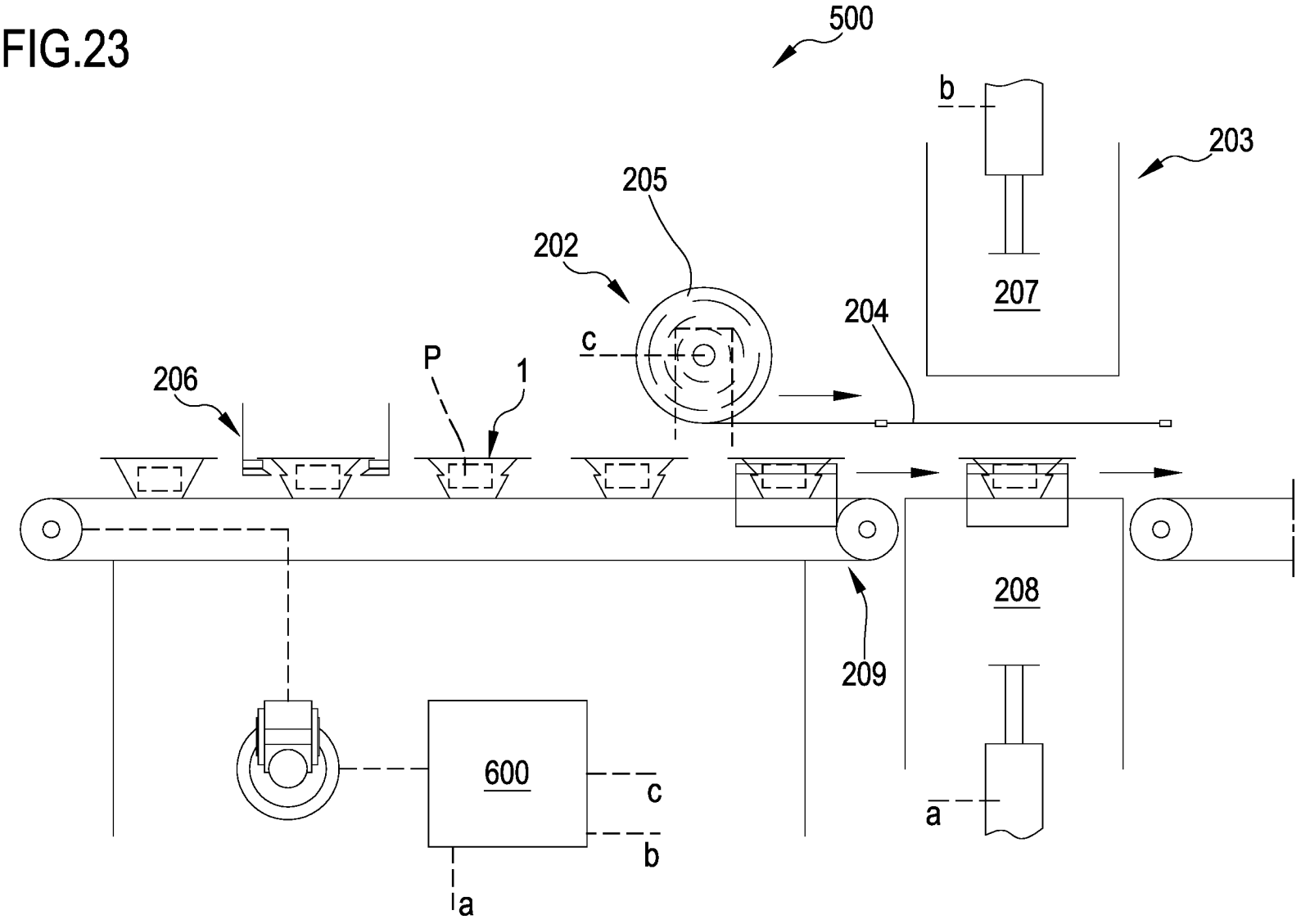
Figure 29:
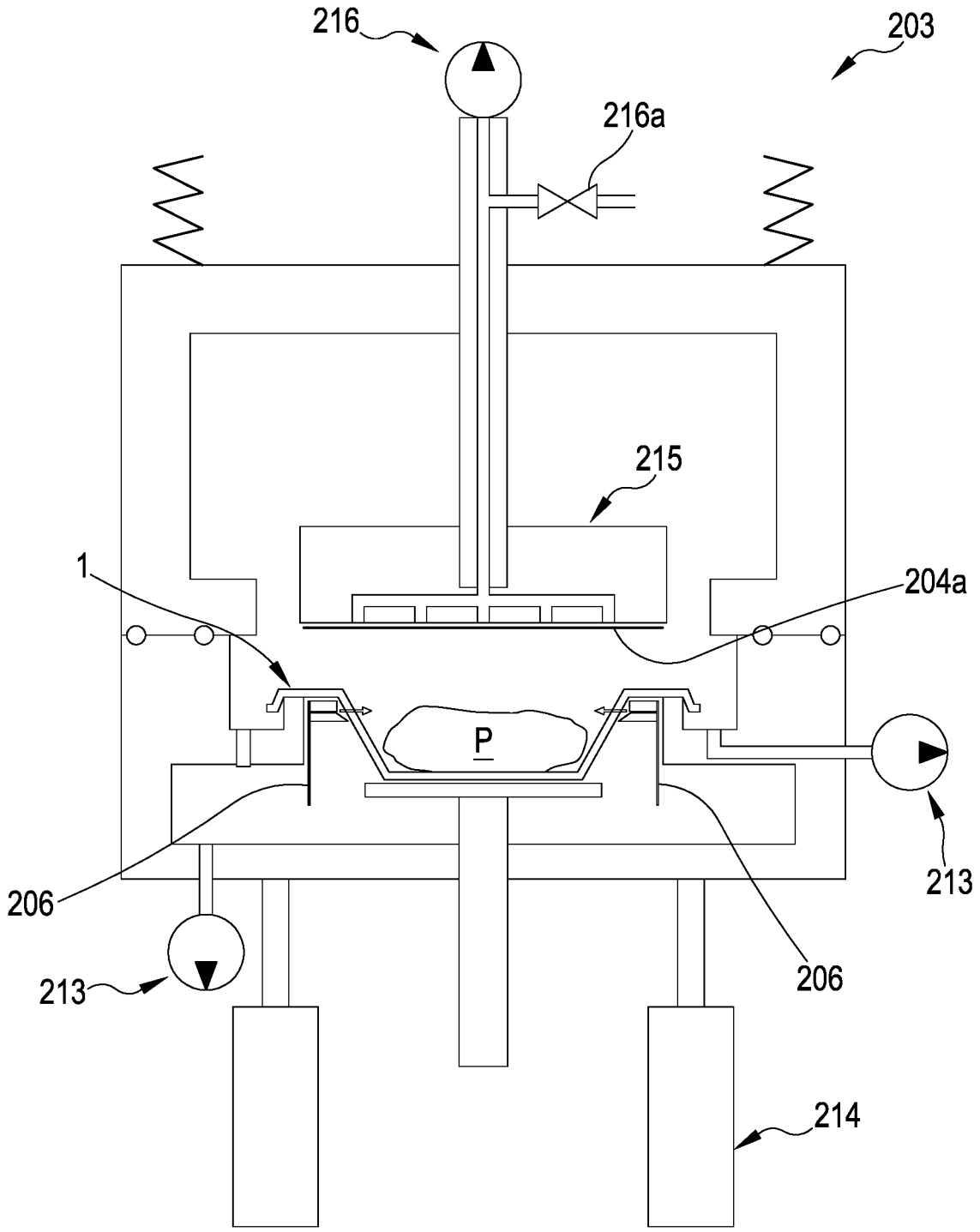
Figure 30:
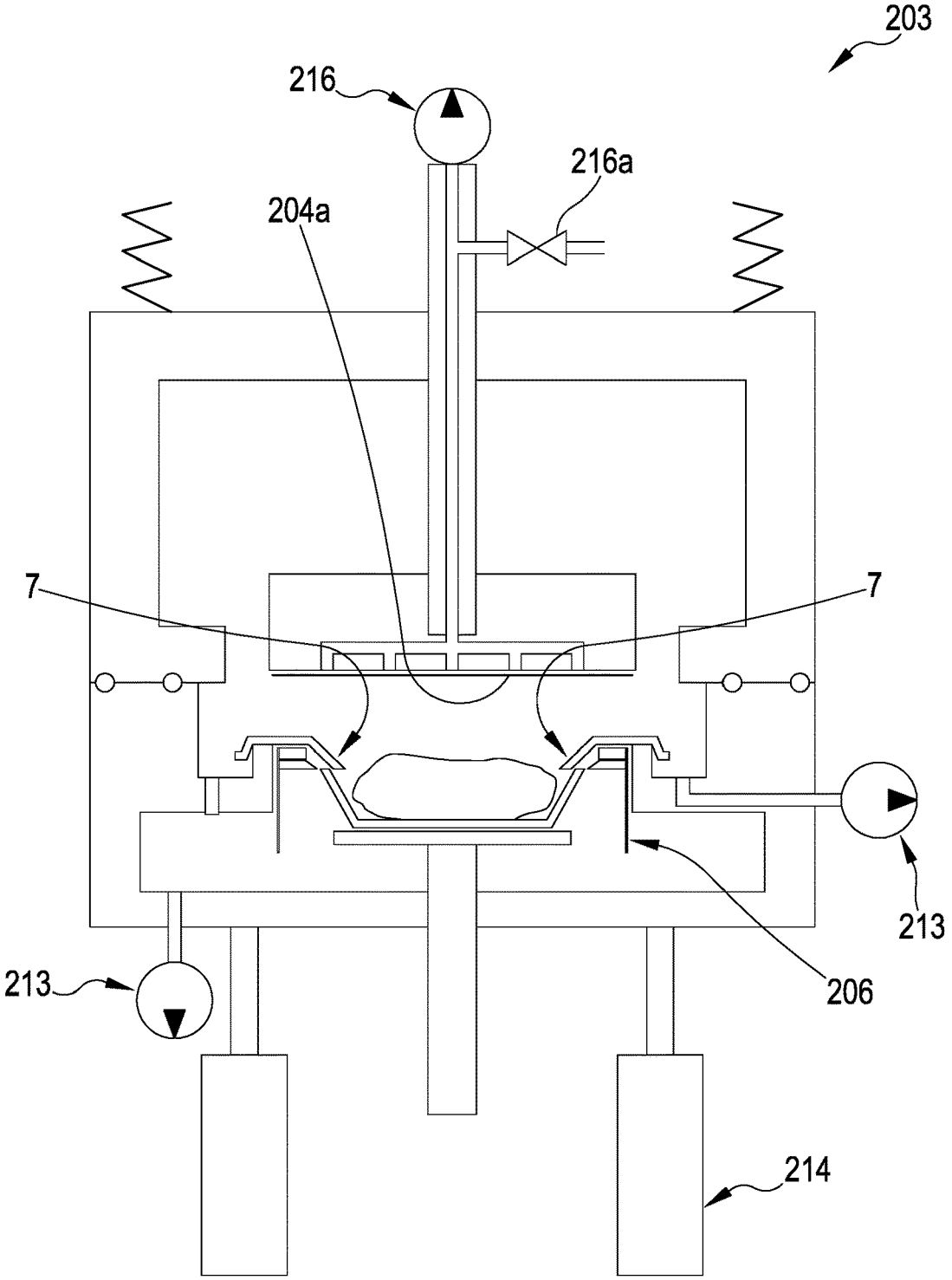

FIGS. from 2 to 4 are detailed perspective views of different embodiments of the tray according to the present invention;

FIGS. from 5 to 7 are further views of a tray according to the present invention, wherein the same tray is illustrated in a predetermined operative condition;

FIGS. 8 and 9 are perspective views of a further embodiment of the tray according to the present invention;

FIGS. 10 and 11 are schematic views of a further embodiment variant of a tray according to the present invention, wherein the same tray is respectively placed in two different operative conditions;

FIG. 12 is a perspective view of a package according to the present invention;

FIG. 13 is a detailed view of the package in FIG. 9A,

FIGS. 14 and 18 are schematic views of an apparatus for forming a tray according to the present invention;

FIG. 19 is an embodiment variant of an apparatus for forming a tray according to the present invention;

FIG. 20 is a plan view of a semifinished product for forming a tray according to the present invention;

FIGS. 20A and 20B are schematic views of a folding area of the tray according to the present invention;

FIGS. 21 and 22 are schematic lateral views of a packaging apparatus according to the present invention wherein a film is unwound from a reel and precut as a sheet outside a packaging station of the apparatus itself wherein the film sheet is heat sealed on the tray;

FIG. 23 is a schematic lateral view of a further packaging apparatus according to the present invention wherein a film is supplied—from a reel—to a packaging station of the apparatus itself wherein the film is heat sealed on the tray and cut as discrete sheets;

FIGS. from 24 to 28 are respective schematic lateral views of a packaging station of the packaging apparatus according to the present invention;

FIGS. 29 and 30 are schematic lateral views of a packaging station of the packaging apparatus according to the present invention.

DEFINITIONS AND CONVENTIONS

It is noted that corresponding parts shown in the different figures are indicated with the same numeral references in the present detailed description. The figures could illustrate the object of the invention by not-to-scale views; therefore, parts and components illustrated in the figures regarding the object of the invention, could refer only to schematic representations.

The term "product" means an article or a composite of articles of any kind. For example, the product can be of a food-type and at the solid, liquid or gel state, in other words it can be in two or more of the said aggregation states. For example, the product can comprise meat, fish, cheese, treated meats, ready and frozen meals of different types.

The term "tray" means a container comprising at least a substantially flat base and at least a lateral wall emerging from the external perimeter of the base; the tray defines a volume inside which a product can be housed. Moreover, the tray can comprise an upper edge portion radially emerging from a free edge of the lateral wall opposite to the base: the upper edge portion emerges from the lateral wall according to a direction exiting from the volume of the tray itself.

The tray can have a base of a rectangular, diamond, circular or elliptical shape. The tray can be formed by a dedicated manufacturing process or can be made in-line to a packaging process.

Tray

The tray can be made at least partially of a paper sheet material. The term "paper material" means paper or paperboard; particularly, the sheet material useable for making the tray can comprise a grammage comprised between 50 and 600 g/m$^2$, particularly comprised between 100 and 500 g/m$^2$, still more particularly between 150 and 400 g/m$^2$. The paper material of interest extends between a first and second prevalent development surfaces. The sheet paper material used for making the tray can, in an embodiment variant, be covered for at least part of the first and/or second prevalent development surfaces by a coating of plastic material, for example a food-grade film. In case the coating is disposed so that it covers at least part of the first prevalent development surface, the coating itself will define an internal surface of the tray. On the contrary, in case the coating is disposed on the second prevalent development surface, the coating itself will define an external surface of the tray. Moreover, the coating can be thermally treated so that it can act as an element for engaging and fixing portions of the tray as will be better described in the following. Moreover, the coating can be used for defining a kind of water and/or moisture barrier useful to avoid to weaken the tray and to prevent a loss of structurality thereof with a following uncontrolled deformation of the paper material forming this latter component. The coating can be applied to the paper material (as hereinbefore specified on the internal and/or external sides of the tray) as the known "coating" or lacquer having a thickness generally comprised between 20 and 400 μm, particularly between 30 and 200 μm, still more particularly between 30 and 80 μm.

Advantageously, but in a non-limiting way, the coating can comprise an extrusion-coating on one or both (internal and/or external sides) of the paper material defining the tray with thicknesses which can vary from 20 to 400 μm for example, particularly from 30 to 200 μm, still more particularly from 30 to 80 μm, of the coating material (in other words of polythene). The coating plastic material can be for example selected among the following materials: LDPE, HDPE, PP, PE, polyesters, PVdC.

As an alternative, the tray can be made at least partially of mono-layer and multi-layer thermoplastic materials. Preferably, the tray is provided with gas barrier properties. This term, as herein used, refers to a film or sheet of a material having an oxygen transmission rate less than 200 cm$^3$/m$^2$-day-bar, less than 150 cm$^3$/m$^2$-day-bar, less than 100 cm$^3$/m$^2$-day-bar, when measured according to the standard ASTM D-3985 at 23° C. and with a relative humidity of 0%.

Gas barrier materials adapted for mono-layer thermoplastic containers are polyesters, polyamides and similar, for example.

Preferably, the tray is made of a multi-layer material comprising at least one gas barrier layer and at least one heat sealable layer for enabling to weld the coating film to the tray surface. The gas barrier polymers which can be used as gas barrier layer are PVDC, EVOH, polyamides, polyesters and mixtures thereof. PVDC is any vinylidene chloride copolymer wherein a main amount of the copolymer comprises vinylidene chloride and a minor amount of the copolymer comprises one or more unsaturated monomers copolymerizable with it, typically vinyl chloride and alkyl acrylates or methacrylates (for example methylacrylates or methacrylates) and mixture thereof with different proportions. Generally, a barrier layer of PVDC will contain plasticizers and/or stabilizers as it is known in the art. The term "EVOH", as herein used, includes saponified or hydrolyzed ethylene-vinylacetate copolymers and refers to ethylene/vinyl alcohol copolymers having a content of ethylene co-monomer preferably consisting in a percentage between about 28 and about 48 moles %, more preferably between about 32 and about 44 moles % of ethylene and still more preferably, and a saponification degree of at least 85%, preferably of at least 90%.

The term "polyamides" refers to omo- and co- or ter-polymers. This term specifically includes aliphatic polyamides or co-polyamides, for example 6-polyamide, 11-polyamide, 12-polyamide, 66-polyamide, 69-polyamide, 610-polyamide, 612-polyamide, 6/9 co-polyamide, 6/10 co-polyamide, 6/12 co-polyamide, 6/66 co-polyamide, 6/69 co-polyamide, aromatic polyamides or co-polyamides and partially aromatic, as 61-polyamide, 6I/6T polyamide, MXD6 polyamide, MXD6/MXDI polyamide, and mixtures thereof.

The term "polyesters" refers to polymers obtained by a polycondensation reaction of dicarboxylic acids with dihydroxylic alcohols. Suitable dicarboxylic acids are for example, terephthalic acid, isophtalic acid, dicarboxylic 2,6-naphtalene acid, and similar. Suitable dihydroxylic alcohols are, for example, ethylene glycol, diethylene glycol, 1,4-butanediol, 1,4-cyclohexanedimethanol and similar. Examples of useful polyesters include terephthalate polyethylene and copolyesters obtained by a reaction of one or more carboxylic acids with one or more dihydroxylic alcohols.

The thickness of the gas barrier layer preferably will be determined for providing the material of which the tray is made, with an oxygen transmission rate at 23° C. and with a relative humidity of 0%, less than 50, preferably less than 10 $cm^3/m^2 \cdot d \cdot atm$, when measured according to the standard ASTM D-3985.

Generally, the heat sealable layer will be selected among polyolefins, such as ethylene omo- or co-polymers, propylene omo- or copolymers, ethylene/vinyl acetate copolymers, ionomers and omo- or co-polyesters, for example PETG, a glycol-modified terephthalate polyethylene. The term "copolymers" as herein used, means a polymer obtained by two or more types of monomers and includes ter-polymers. The ethylene omo-polymers include high density polyethylene (HDPE) and low density polyethylene (LDPE). Ethylene copolymers include ethylene/alpha-olefin copolymers and unsaturated ethylene/ester copolymers. The ethylene/alpha-olefin copolymers generally include ethylene copolymers and one or more comonomers selected from alpha-olefins having 3-20 carbon atoms, such as 1-butene, 1-pentene, 1-hexene, 1-octene, 4-methyl-1-pentene and similar.

The ethylene/alpha-olefin copolymers have generally a density in the range from about 0.86 to about 0.94 $g/cm^3$. Generally, the term linear low density polyethylene (LLDPE) includes a group of ethylene/alpha-olefin copolymers falling in the density range from about 0.915 to about 0.924 $g/cm^3$, and particularly from about 0.915 to about 0.925 $g/cm^3$. Sometimes, the linear polyethylene in the density range from about 0.926 to about 0.94 $g/cm^3$ is known as linear medium density polyethylene (LMDPE). The ethylene/alpha-olefin copolymers having a lower density are known as very low density polyethylene (VLDPE) and ultra low density polyethylene (ULDPE). The ethylene/alpha-olefin copolymers can be obtained by heterogeneous or homogeneous polymerization processes. Another useful ethylene copolymer is an unsaturated ethylene/ester copolymer which is the ethylene copolymer and one or more unsaturated ester monomers. Useful unsaturated esters include vinyl esters of aliphatic carboxylic acids, wherein the esters have from 4 to 12 carbon atoms, such as vinylacetate and alkyl esters of acrylic or methacrylic acid, wherein the esters have from 4 to 12 carbon atoms. The ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers which are propylene and ethylene copolymers containing mainly propylene and propylene/ethylene/butene ter-polymers by percentage weight, which are propylene, ethylene and 1-butene copolymers.

Additional layers, such as adhesive layers, for example for better adhering the gas barrier layer to the adjacent layers, can be preferably present in the material forming the tray and are selected based on specific resins used for the gas barrier layer.

In case of a multi-layer structure, portion thereof can be formed as a foam. For example, the multi-layer material used for forming the tray can comprise (from the most outer layer to the most inner layer contacting the food) one or more structural layers, typically made of a material such as foamed polystyrene, foamed polyester or foamed polypropylene, or paperboard, or a cast sheet for example of polypropylene, polystyrene, poly(vinyl chloride), polyester, a gas barrier layer and a heat sealable layer.

An easily-openable frangible layer can be placed adjacent the heat sealable layer for making easier to open the final package. Mixtures of polymers having a low cohesive strength which can be used as a frangible layer are described in document WO99/54398, for example. The overall thickness of the tray will typically amount, in a non-limiting way, to 5.00 mm, preferably is comprised between 0.04 and 3.00 mm, and more preferably between 0.05 and 1.50 mm, still more preferably between 0.15 and 1.00 mm.

The tray can be integrally made of paper material (optionally the coating is of a plastic material film) or can be integrally made of plastic material. In a further embodiment variant, the tray is at least partially made of paper material and at least partially of plastic material; particularly, the tray is internally made of plastic material and externally coated at least partially by a paper material.

Skin or Film

A film or skin is applied to the tray in order to obtain a fluid-tight package housing the product. Since the object consists of obtaining a vacuum package, the film applied to the tray is typically a flexible multi-layer material comprising at least one first external heat sealable layer capable of being welded to the internal surface of the tray, optionally a gas barrier layer and a second heat-resistant external layer. The polymers used in said multi-layer material should be easily formable since the film must be stretched and softened by the contact with the heating plate before being laid on the product and tray. The film must be laid on the product in order to conform to the shape thereof and possibly to the internal shape of the tray.

The heat sealable external layer can comprise any polymer capable to be welded to the internal surface of the tray. Polymers adapted to the heat sealable layer can be ethylene omo- and co-polymers, such as LDPE, ethylene/alpha-olefin copolymers, ethylene/acrylic acid copolymers, ethylene/methacrylic acid copolymers or ethylene/vinylacetate copolymers, ionomers, co-polyesters, for example PETG. The preferred materials for the heat sealable layer are LDPE, ethylene/alpha-olefin copolymers, for example LLDPE, ionomers, ethylene/vinylacetate copolymers and mixtures thereof.

As a function of the product to be packaged, the film can comprise a gas barrier layer. The gas barrier layer typically comprises oxygen barrier resins, such as PVDC, EVOH, polyamides and mixtures of EVOH and polyamides. Typically, the thickness of the gas barrier layer is set for providing the film with an oxygen transmission rate at 23° C. and a relative humidity of 0%, less than 100 $cm^3/m^2 \cdot d \cdot atm$, preferably less than 50 $cm^3/m^2 \cdot d \cdot atm$, when measured according to the standard ASTM D-3985. Routine polymers for the heat resistant external layer are, for example, ethylene omo- or co-polymers, ethylene/cyclic olefin copolymers, such as ethylene/norborene copolymers, propylene omo- or co-polymers, ionomers, polyesters, polyamides. The film can further comprise other layers such as adhesive layers, bulk layers and similar for providing the thickness necessary to the film and for improving the mechanical properties thereof, such as the puncture resistance, the abuse resistance, the formability and similar. The film is obtained by any adapted co-extrusion process, by an extrusion head with a flat or circular opening, preferably by co-extrusion or by heat blowing.

The film to be used in a "skin-pack" or "VSP" packaging process, known also as vacuum process, is substantially non-oriented. Typically, the film, or one or more of the layers thereof, is cross-linked for improving, for example, the film strength and/or heat resistance when this film is brought in contact with the heating plate during the skin-pack vacuum packaging process. The cross-linking can be obtained by using chemical additives or subjecting the film layers to an energy radiation treatment, such as a high energy electron beam treatment, for promoting the cross-linking among the molecules of the irradiated material. Films adapted for this application have a thickness in the range from 50 to 200 micrometers, from 70 to 150 micrometers. Films adapted to be used as a film in a vacuum skin-pack packaging process are for example commercially available from Cryovac® with the trademarks TS201®, TH300®, VST™0250, VST™0280.

DETAILED DESCRIPTION

Tray

1 generally indicates a tray containing a product P, for example a food-type product. The attached figures illustrate a condition wherein the tray 1 contains just one product P (see FIG. 12, for example); however, it is not excluded the possibility of housing a plurality of products P in the tray.

As it is visible in the attached figures, the tray 1 comprises a base 2 of sheet material developing in a plane between a prevalent development internal surface and external surface, the distance thereof delimits the thickness of the base 2. The attached figures illustrate, in a non-limiting way, a base 2 having a polygonal shape, particularly a square one. However, it is not excluded the possibility of making a base 2 having a rectangular, diamond, triangular, elliptical, circular, semicircular shape.

As it is visible from the attached figures, from the base 2 emerges a lateral wall 3 also made of sheet material, developing between a prevalent development internal surface and external surface, the distance thereof delimits the thickness of the wall 3. The lateral wall 3 extends from the base 2 starting from an external perimetral edge of this latter: the base 2 with the lateral wall 3 defines a containing seat adapted to receive the product P. Particularly, the containing seat of the tray 1 is defined by the internal surfaces of the base 2 and of the lateral wall 3. The lateral wall 3 emerges along a direction transversal to the plane of the base 2 for defining a convex containing seat. More particularly, the lateral wall 3 is sloped with respect to the base 2 plane in order to define an angle, subtended between the internal surface of the base 2 and the internal surface of the lateral wall 3, comprised between 60° and 89°, particularly comprised between 70° and 85°. However, it is not excluded the possibility of making a lateral wall developing normal to the base 2 plane (this arrangement is not illustrated in the attached figures).

As hereinbefore described, the lateral wall 3 extends away from the base 2 starting from a perimetral edge of this latter. The lateral wall 3 extends from the base 2, in a non-limiting way, following the shape of this latter. The attached figures illustrate a configuration of the tray 1 wherein the lateral wall 3 defines, along a cross-section transversal to the extension direction of the wall 3 itself, also a square shape according to the shape of the external perimeter of the base 2.

As it is visible in the attached figures, the lateral wall 3 is delimited by a free edge 4 opposite to the base 2 and defining an opening of the tray 1. The edge 4 is an upper edge of the tray 1 delimiting the opening of the tray itself, through which the product P—for example the food product—is inserted for being positioned in the containing seat of the tray 1 and then is covered during the packaging step. Advantageously, the edge 4 of the lateral wall 3 exhibits a shape according to the shape of the external perimeter of the base 2. Actually, the attached figures illustrate an embodiment of the tray 1, wherein the external perimeter of the base 2 and edge 4 of the lateral wall 3 exhibit both a square shape; generally, the edge 4 of the lateral wall has the same shape (equal in shape and optionally in size) as the external perimeter of the base 2.

More particularly and as it is visible in FIG. 1 for example, the lateral wall 3 comprises a plurality of angular portion 5, each of them defines a corner of the polygonal shape of the lateral wall. Particularly and as it is visible in the attached figures, the angular portion 5 is defined by a first and second sides of the lateral wall 3 immediately adjacent to each other, which intersect to define a corner of the lateral wall 3. In a further embodiment of the tray 1 illustrated in FIG. 1A, the tray 1 comprises one or more curved portions 6; in the configuration wherein the lateral wall 3 exhibits a circular or elliptical shape, the curved portion 6 represents the overall lateral wall 3 of the tray 1. FIG. 1A illustrates an embodiment of the lateral wall 3 wherein the same exhibits, along a cross-section, a square shape having radiused corners: in such configuration, the lateral wall 3 comprises four curved portions 6 represented by fillets (radiused portions) of the lateral wall 3.

In a preferred but non-limiting embodiment of the invention, the tray 1 further comprises a flange 15 emerging transversally from the lateral wall 3, starting from the edge 4, away from the containing seat. The flange 15 represents a perimetral extension of the edge 4 placed at the opening of the tray 1. The flange 15 extends along a closed outline around the opening of the tray 1 along a plane transversal to a development surface of the lateral wall 3; particularly, the flange extends along a development plane substantially parallel to the development plane of the base 2.

In a preferred but non-limiting embodiment of the invention, the base 2 and lateral wall 3 are integrally made; as it will be better described in the following, the base 2 and lateral wall 3 are obtained by deforming a same sheet. Advantageously, also the flange 15—if present—is integrally made with the lateral wall 3 and therefore with the base 2 of the tray 1: the base 2, lateral wall 3 and flange 15 form a single solid body.

The tray 1 can be completely made of a plastic material and, as it will be better described in the following, can be obtained by thermoforming. In a further embodiment, the tray 1 is completely made of paper material and, as it will be better described in the following, can be obtained by die-cutting and then deep-drawing a flat sheet.

If the tray 1 is made of paper material, the products, for example food products, at least on the first surface of the tray (internal surface) are protected by a coating of plastic material, for example a film, which covers at least part of the first surface itself. Particularly, the coating of plastic material completely covers the internal surface of the tray 1. The object of the coating consists of defining a barrier particularly a water and/or moisture barrier preventing the weakening and loss of structurality with the following deformation of the paper material forming the tray 1. The coating plastic material can be selected for example among the following materials: LDPE, HDPE, PP, PE, polyesters, PVdC and can be placed on one (the internal side of the tray) or on both the sides of the paper material (the internal and external sides of the tray) with values which can for example vary from 20 to 400 gr/m$^2$ of the coating material, particularly between 30 and 200 gr/m$^2$, still more particularly between 30 and gr/m$^2$. As it will be further described in the following, the coating, besides defining a protecting layer of the paper tray, can act as an element engaging the folded walls obtained during the step of deep-drawing the paper sheet; indeed the plastic coating can be heated during the step of deep-drawing the paper sheet and used for heat sealing the lateral wall portions defining a surplus of material, which therefore, at the end of the deep-drawing step, are overlapped on each other. Such process will be better described in the following.

As it is visible in FIGS. from 1 to 3, the lateral wall 3 comprises—at at least one angular portion 5 and/or curved portion 6—at least one cut 11 passing through the thickness of the lateral wall 3 or a weakening line 12 for example definable by a portion of the lateral wall, pressed into the thickness or partially cut. The cut 11 or weakening line 12 develops along a plane transversal to the development surface of the lateral wall 3. The attached figures illustrate an embodiment of the tray 1, wherein the cut 11 or weakening line 12 develops along a plane substantially parallel to the development plane of the base 2.

Specifically, the cut 11 or weakening line 12 of the lateral wall 3 is interposed between the edge 4 of the lateral wall 3 and the base 2; optionally, the cut 11 or weakening line 12 is disposed at the midline of the lateral wall 3. As hereinbefore described, the cut 11 or weakening line 12 is defined at the angular portion 5 and/or curved portion 6 of the lateral wall 3.

If the cut 11 or weakening line 12 is defined on the angular portion, the cut itself 11 (or also the weakening line 12) extends for a predetermined length along both the sides (the first and second sides) defining the angular portion 5. More particularly, part of the cut 11 (or also of the weakening line 12) extends for a determined length along a first side to the corner of the angular portion 5 and for a determined length along the second side to the corner of the angular portion 5 itself. De facto, the cut 11 or weakening line 12 of the angular portion 5 is defined by two lengths—particularly rectilinear—developing on the first and second sides of the lateral wall 3 and joining at the corner of an angular portion 5 itself. In a preferred but non-limiting embodiment of the invention, the pair of lengths defining the cut 11 (or also the weakening line 12) exhibit the same extension (same length).

FIG. 1A on the contrary illustrates a tray 1 exhibiting curved portions 6; in such configuration, the cut 11 (or also the weakening line 12) extends at least partially for the extension of the joining portion defined by the portion 6. FIG. 1A illustrates a preferred but non-limiting embodiment of the invention wherein the cut 11 (or also the weakening line 12) extends along all the development of the joining portion defining the portion 6.

Figure 3:
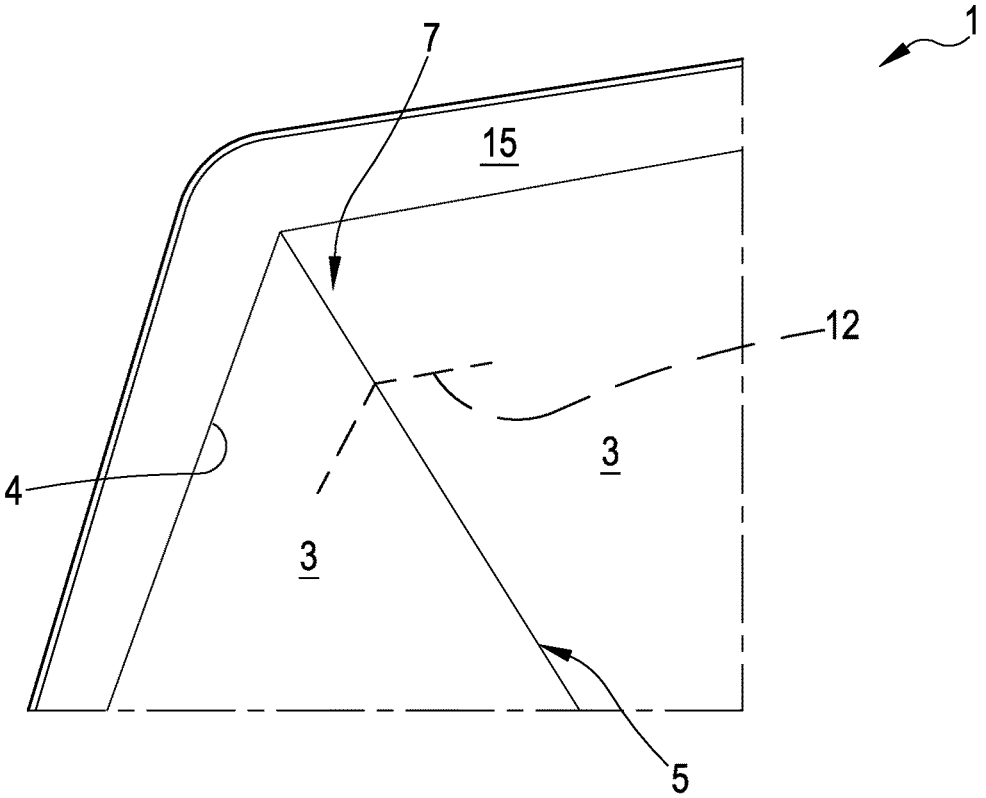
Figure 4:
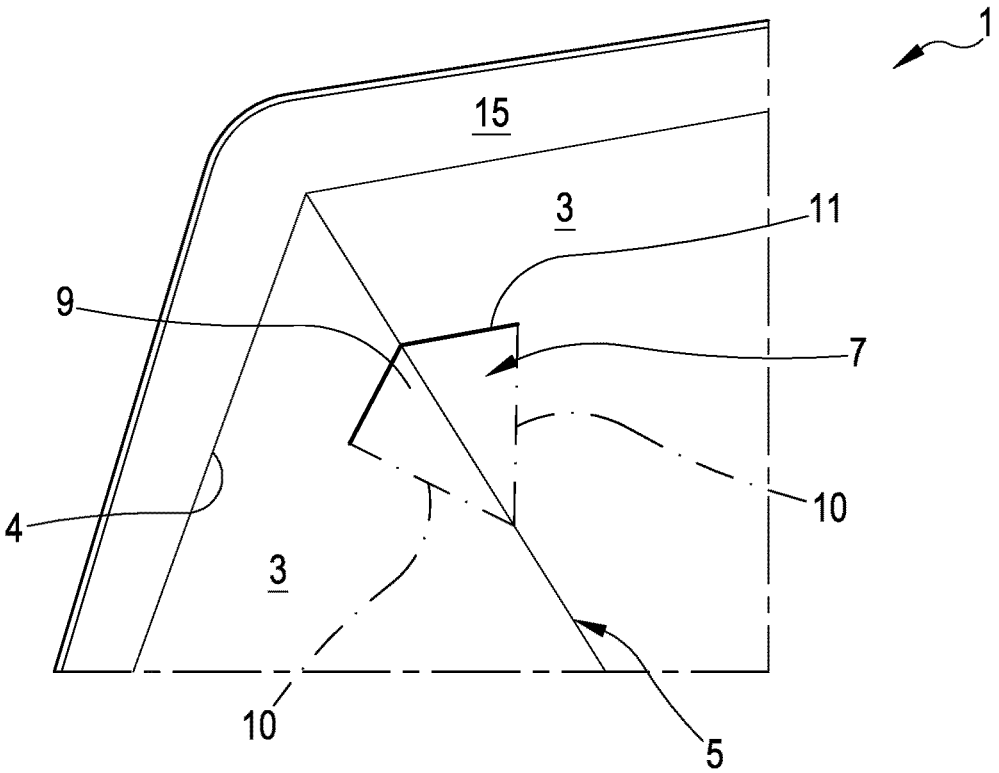
Figure 5:
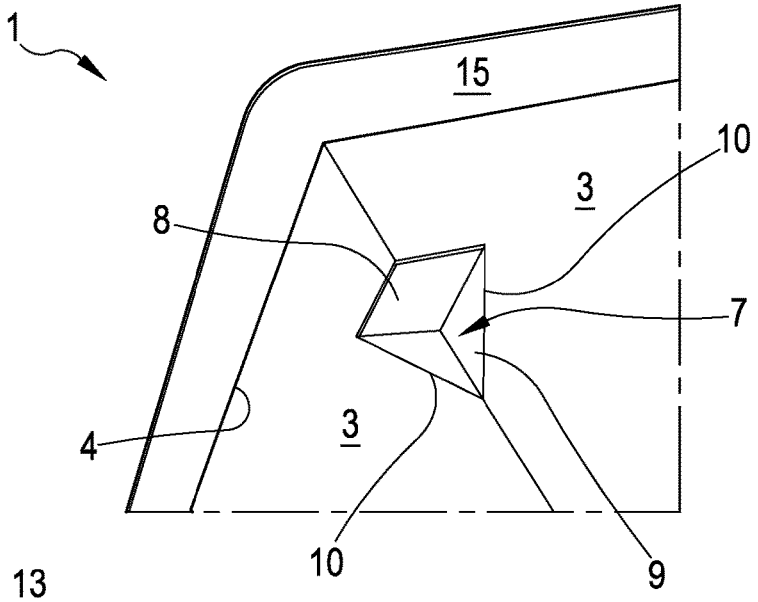

The cut comprises an opening crossing the lateral wall 3 of the tray obtainable by cutting this latter. The weakening line can comprise a reduction in thickness of the lateral wall or a pre-cut segment of the lateral wall defined by a plurality of cuts aligned along a predetermined path and alternated by uncut portions of the lateral wall (see the outline of a pre-cut for example in FIG. 3).

Each cut 11 (or also each weakening line 12) is configured for promoting, on the portions 5 and 6 of the lateral wall 3, the formation of a movable portion 7, particularly of a foldable portion 7, movable with respect to the base 2; FIG. 1 illustrates a preferred but non-limiting configuration of the invention wherein the tray 1 exhibits two movable portions 7 disposed at two angular portion 5 opposite to each other with respect to the base 2 of the tray 1. However, it is not excluded the possibility of making just one movable portion or three or more movable portions 7, for example a movable portion 7 for each angular portion 5. The movable portion 7 is configurable between the following operative positions of stability:

- at least one first stable position wherein the movable portion 7 is disposed in continuity with respect to the lateral wall 3, and
- at least one second stable position wherein said movable portion 7 protrudes from the lateral wall 3, particularly inside the containing seat of the tray 1, and defines an access 8 passing through the lateral wall 3 itself.

The movable portion 7 is defined at at least one non-flat surface of the lateral wall 3 of the tray 1: the lack of planarity of the surface on which the portion 7 (defined on the angular surface 5 and/or curved surface 6) is defined, enables the portion 7 to fold with respect to the lateral wall 3, and particularly to determine the stability of the first and second positions of the portion 7 itself. De facto, only after exerting a specific action on the movable portion 7—a stress directed transversal to the prevalent development surface of the lateral wall 3—it is possible to determine the movement of the portion 7 from the first to the second stable positions, and viceversa.

FIGS. from 5 to 9 illustrate a tray 1 wherein the movable portion 7 is disposed in the second stable position. As hereinbefore described, in such position, the portion 7 emerges from the angular portion 5 or curved portion 6 inside the containing seat of the tray 1. The movable portion 7, in the second stable position and together with the lateral wall 3, defines an access (see FIGS. from 5 to 9) passing through the lateral wall 3 itself. The access 8 is interposed between the base 2 and free edge 4 of the lateral wall 3. More specifically, the access 8 is delimited by at least one free edge 13 of the movable portion 7 and by at least one intermediate edge 14 of the lateral wall 3: the intermediate edge 14 and edge 13 of the foldable portion 13 are both defined by the cut 11 or weakening line 12.

The attached figures illustrate, in a non-limiting way, a configuration of the movable portion 7 obtained by making only one cut 11 or weakening line 12 on the portion 5 or 6. In such condition, the portion 7 is obtainable both above said cut 11 (in the same way above the weakening line 12) so that the portion 7 is interposed between said cut 11 and edge 4 of the lateral wall 3 (see FIGS. 8 and 9 for example) and below the cut 11 (in the same way below the weakening line 12), so that the portion 7 is interposed between said cut 11 and base 2 of the tray 1 (see FIGS. from 5 to 7, for example).

In a further embodiment illustrated in FIGS. 10 and 11, the same angular portion 5 or the same curved portion 6 is provided with at least two cuts 11 (as an alternative, two weakening lines 12 or a cut 11 and a weakening line 12) distanced from each other along the development of the portion 5 or 6. In such configuration, the movable portion 7 is defined between said pair of cuts 11 (see FIGS. 10 and 11). FIGS. 10 and 11 illustrate a tray 1 wherein the pair of cuts 11 is defined on an angular portion 5; obviously, it is not excluded the possibility of making a pair of cuts 11 or weakening lines 12 on one or more curved portions 6 (this condition is not illustrated in the attached figures). In such configuration, in the second stable position, the movable portion 7 (FIG. 11) defines—cooperatively with the lateral wall 3—two accesses 8 passing through the lateral wall 3 of the tray 1. FIG. 11 specifically illustrates the portion 7 disposed in the second stable position wherein the portion itself emerges from the angular portion 5 along a sense entering the containing seat of the tray 1; in such position, the movable portion 7 defines—cooperatively with the lateral wall 3—an upper access and lower access passing through the wall 3 itself.

On the contrary, FIG. 10 illustrates the movable portion 7 placed in the first stable position wherein the portion 7 substantially does not protrude from the lateral wall 3; in such configuration, the portion 7 extends in continuity with the angular portion 5: in the first stable position of the portion 7 itself the same does not define any type of access (the lateral wall is substantially closed). Still in other words, in the first position of the movable portion 7, the access 8 or accesses 8 are closed by the movable portion 7 itself.

More particularly, the movable portion 7 comprises at least one tab 9 engaged with the lateral wall 3 by a hinge-type constrain. Still more particularly, the movable portion 7 is engaged with the lateral wall by at least one folding line 10 extending transversally to the development of the cut 11 or weakening line 12. Particularly, the folding line 10 extends along the lateral wall 3 transversally to the development plane of the base 2.

The tab 9 is configured for rotatively moving with respect to the lateral wall 3 about the folding line 10. Advantageously, the movable portion 7 is integrally made with the lateral wall 3 of the tray 1; the folding line 10 can, for example, comprise a creasing line or pressed portion of the lateral wall 3, adapted to guide the rotation of the tab 9 about the line 10 itself and therefore to move the movable portion 7 from the first to the second stable position, and viceversa.

In the configuration wherein the movable portion 7 is defined at an angular portion 5, the portion 7 itself defines a foldable portion 7 comprising a first tab 9*a* connected to the first side of the angular portion 5 by a first folding line 10*a*; in such configuration, the foldable portion 7 further comprises a second tab 9*b* connected to the second side of the angular portion 5 itself by a second folding line 10*b*. The first and second tabs 9*a*, 9*b* are connected to each other by an intermediate folding line 10*c* (see FIGS. from 5 to 11, for example).

Figure 6:
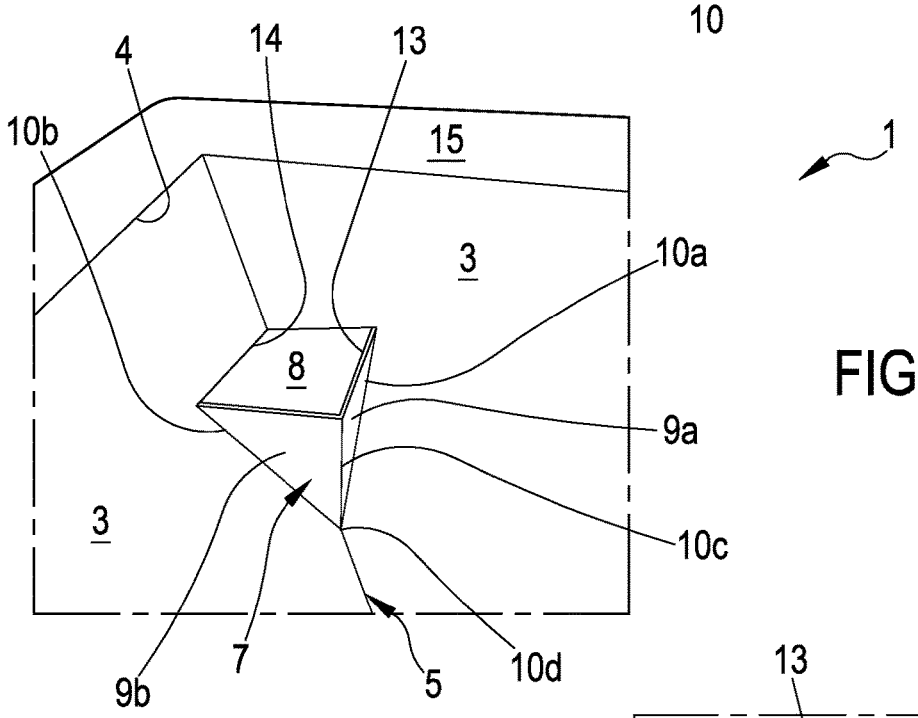
Figure 7:
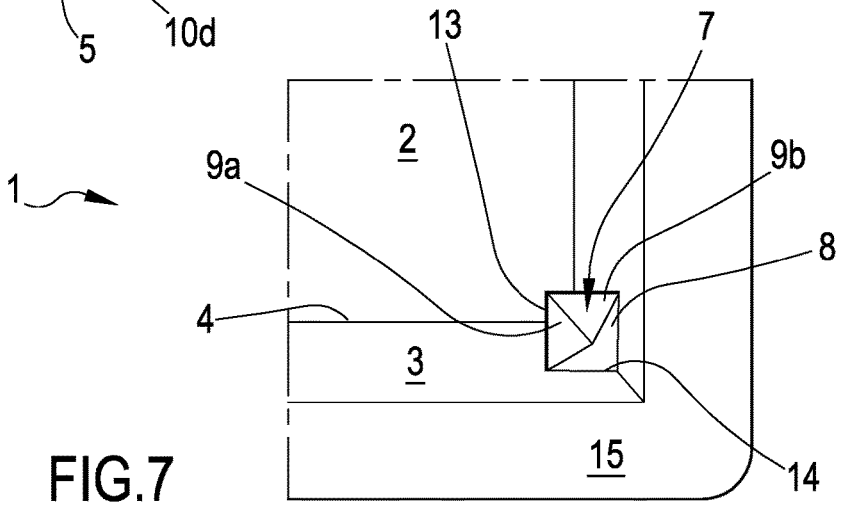

Still more particularly, the foldable portion 7, in the second stable position, exhibits, along a cross-section, a substantially "L" or "V" shape, the concavity thereof faces away from the containing seat of the tray (see FIG. 6, for example). The foldable portion 7, in the first stable position, has, along a cross-section, a substantially "L" or "V" shape, the concavity thereof faces the containing seat of the tray 1 (see FIG. 1, for example).

As hereinbefore described, the foldable portion 7 is obtainable by a single cut 11 or weakening line 12. In such configuration, the foldable portion 7 extends from said cut 11 or weakening line 12 to an intersection point of the folding lines of the portion itself. In fact, by observing the embodiment in FIG. 6, we can note that the foldable portion 7 is movable about the folding lines 10*a* and 10*b*, which intersect at a point 10*d* of the corner of the angular portion 5: the foldable portion 7 has a cross-section increasing from such point 10*d* to its free edge 13.

Viceversa, when the portion 7 is defined between two cuts 11 or weakening lines 12, the portion 7 itself exhibits a cross-section substantially constant along the development of the angular portion 5 or 6 (see FIGS. 10 and 11, for example).

On the contrary, FIG. 1A illustrates a configuration of the movable portion 7 defined at the curved portion 6; in such configuration, the portion 7 comprises a single tab 9 movable about a single folding line 10 having a substantially "U" shape.

Process of Making a Tray

Moreover, it is an object of the present invention a process of making a tray 1 according to what has been hereinbefore described or according to one or more of the attached claims.

The process comprises a step of providing a sheet 303 having a flat shape. The step of providing the sheet 303 comprises a step of unwinding a film from a supplying station 302, for example a reel 302*a*, and moving the same along an advancement direction A.

In a first embodiment, the process is configured for making a tray 1 of plastic material from a film of plastic material. With respect to the first embodiment of the process, the same comprises providing a plastic sheet with a flat configuration. The sheet is advanced along the advancement direction to a following forming station 304 in which the sheet is deformed by thermoforming, so that the sheet itself defines at least a tray-shaped element comprising the base 2 and lateral wall 3 of the tray 1. The attached figures illustrate, in a non-limiting way, a preferred but non-limiting embodiment of the invention, wherein the deforming (thermoforming) step acts on a continuous sheet 303: the sheet 303 therefore defines a precursor body 400 on which the tray-shaped elements having the base 2 and lateral wall 3 of the tray 1 are defined. However, it is not excluded the possibility of precutting the film for defining single portions deformable one by one and respectively configured for defining single trays.

After the deforming step, the process provides making—at the angular portion 5 and/or curved portion of the tray 1—a cut 11 or weakening line 12 developing along a plane transversal to the development surface of the lateral wall 3. In a preferred embodiment of the invention, the cut 11 or weakening line 12 made on the tray—particularly on the lateral wall 3 of the tray-shaped elements—develops along a plane substantially parallel to a development plane of the base 2 of the tray 1: the cut 11 or weakening line are configured for defining the movable portion 7, particularly the foldable portion 7, of the tray 1.

FIGS. from 15 to 18 schematically show a step of making said cut or weakening line by engraving the lateral wall 3 by one or more knives 310. As the precursor body advances, one or more knives move transversally to the direction A for contacting and engraving one or more angular 5 or curved portions 6 of the tray-shaped elements.

As hereinbefore described, the cut 11 or weakening line 12 is adapted to promote the formation of the movable portion 7 on the tray 1. FIGS. from 15 to 18 illustrate an embodiment of the process wherein the step of making the cut or weakening line is performed, in a non-limiting way, immediately after the thermoforming step.

After the step of engraving the cut or weakening line, the process provides, in a non-limiting way, to house one or more products inside the containing seat of the tray-shaped elements 1. Obviously, it is not excluded the possibility of inserting the products P before making the cut 11 or weakening line.

If the thermoforming step is performed on a continuous plastic material film, the process, after positioning the products in the tray-shaped elements, provides to cut transversally to the precursor body 400 in order to obtain the single trays 1.

In a second embodiment, the process is configured for making a tray 1 of, or comprising, a paper material from a sheet 303 of paper material. The same process can comprise a step of providing a plastic film on at least one development surface of the flat sheet 303; the process can comprise providing said film both on the first development surface and on the second surface opposite to the first one so that the sheet 303 of paper material is coated by a plastic material on both sides. For example, the plastic material can be engaged with the sheet 303 of paper material by a laminating (calandering) process.

Moreover, the process provides to unwind the paper material, for example, from a reel 302*a*, for arranging the sheet 303 itself in a flat configuration. The step of laminating (calandering) the plastic film on the paper material sheet can be performed before a step of providing 302*a* so that the sheet 303 going out from said reel is already coated. In an embodiment variant, the step of calandering the plastic film on the paper material sheet can be performed in line with the process for making the tray downstream (particularly immediately after) the step of unwinding the sheet 303.

The sheet is advanced along an advancement direction A and then is cut for defining a flat semifinished product 101. The cutting step can be executed by means of a die-cutter 311. As it is visible in FIG. 20, for example, the semifinished product obtained by the cutting (die-cutting) step comprises at least one central element 102 and at least one perimetral element 103 disposed around the central element 102. More particularly and as it is visible in FIG. 20 for example, the central element 102 has a polygonal shape; the perimetral element 103 instead has:

- a lateral portion 103*a* emerging from each perimetral side of the central element 102; each lateral portion 103*a* emerges away from the central element 102 and is distanced by the further lateral portions 103*a*,
- a plurality of connecting portions 103*b* emerging away from the central element 102 and connecting two lateral portions 103*a* disposed consecutively around said central element 102.

Each connecting portion 103*b* exhibits a substantially triangular shape. One side of the connecting portion is integrally joined, advantageously by a folding line, to a lateral portion 103*a* having a rectangular shape for example. Another side of the connecting portion 103*b* itself is integrally joined to a respective lateral portion 103*a* having for example a rectangular shape (see FIG. 20, for example).

Simultaneously with the cutting step adapted to define the external perimeter of the semifinished product 101, the process provides a step of working the semifinished product 101 in which at least one cut 107 and/or at least one weakening line 108 on the perimetral element 103 are performed: the cut 107 and/or weakening line 108 of the semifinished product 101 are respectively configured for defining the cut 11 and/or weakening line 12 of the tray 1.

More particularly, and as it is visible in FIG. 20 for example, the cut 107 or weakening line 108 of the semifinished product 101 is formed on at least one connecting portion 103*b* of the perimetral element 103; each cut 107 or weakening line 108 is formed on at least one connecting portion 103*b* and in continuity with the lateral portion 103*a* immediately after said connecting portion 103*b*.

In a preferred and non-limiting embodiment of the invention, during the step of working the semifinished product 101, a cut 107 or weakening line 108 extending along a rectilinear direction is formed; two creasing lines 109 obtainable by pressing the semifinished product 101 extend from terminal points of the cut 107 or weakening line 108, which define cooperatively with the respective cut or weakening line a closed outline having a triangular shape; the pair of creasing lines 109 are configured for defining at least part of the folding line 10 of the tray 1 about which the portion 7 is movable—for example by rotation.

Advantageously, each cut 107 or weakening line 108 comprises two respective creasing lines 109 defining with said cut 107 or line 108 a closed outline having a triangular shape.

After making the semifinished product 101, the same is deformed in a deforming station 304; the step of deforming the paper semifinished product 101 advantageously comprises a step of deep-drawing.

The deforming step comprises deforming the semifinished product 101 for folding the perimetral element 103 with respect to the central element 102 for defining a plurality of folding areas 104. Each folding area 104 comprises a first and second overlapping zones 105, 106. The first overlapping zone 105 comprises at least one first and one second portions 105*a*, 105*b* of a first surface of the semifinished product 101, facing and in contact with each other; the second overlapping zone 106 comprises at least one first and one second portions 106*a*, 106*b* of a second surface of the semifinished product, facing and in contact with each other (see FIGS. 20A and 20B, for example). The deforming step defines the lateral wall 3 of the tray 1, in which each folding area 104 defines the angular portion 5 or curved portion 6 of the lateral wall 3. More particularly, the connecting portion 103*b* of the semifinished product after the deforming step, defines at least part of the folding line 104 (see FIGS. 20A and 20B, for example).

As hereinbefore described, the first surface of the paper sheet can be coated by a film or skin of plastic material. In such configuration, after the step of deforming the semifinished product 101, the film or skin coats completely the containing seat of the tray.

In a further embodiment variant of the invention, the process comprising engaging the film or skin of plastic material (for example by a process of laminating the paper sheet with the plastic film) on the first and second surfaces of the paper sheet so that the opposite surfaces of the semifinished product 101 are completely coated by said film. In such configuration, during the step of deforming (deep-drawing) the semifinished product 101, the process can comprise heating the deforming semifinished product 101 so that said film or skin can stably constrain to each other:

- the first and second portions 105*a*, 105*b* of the first surface of the semifinished product, and
- the first and second portions 106*a*, 106*b* of the second surface of the semifinished product.

The film or skin of plastic material is substantially configured for stably holding the tray in the deformed three-dimensional configuration thereof.

Moreover, it is not excluded the possibility of providing a semifinished product 101 of paper material without the plastic coating; in such configuration, the process can comprise—after the step of forming the semifinished product 101—a step of applying a predetermined amount of glue on at least one part of the lateral portion 103*a* and/or on a part of the connecting portion 103*b*. After applying the predetermined amount of glue, the semifinished product is deformed (deep-drawn) so that the glue can stably constrain to each other the surfaces of the folding area 104 (see FIGS. 20A and 20B).

It is possible to prepare the sheet 303 of paper material coated on one or both the sides with a film of plastic material using also processes alternative to the above described calandering process. For example, the plastic material film or films can be heat applied by a vacuum technique by introducing the paper material sheet and films into a suitable environment configured so that between each plastic film and paper material a vacuum state is generated for enabling to adhere the plastic film or films to the paper material and therefore to form a multi-layer comprising the paper material and the coating or coatings of plastic material.

Moreover, it is not excluded the possibility of making a tray of paper material without a coating: with such configuration, the tray is only made of paper material.

Apparatuses for Making the Tray

In addition, it is an object of the present invention an apparatus 300 for making the tray 1 according to one or more of the attached claims.

As it is visible in FIGS. 14 and 19 for example, the apparatus 300 comprises a fixed frame 301 configured for enabling to abut the apparatus 300 on the ground and for engaging the different components of the same which will be fully described in the following. De facto, the fixed tray 301 stably support all the components of the apparatus 300 and enables to define a predetermined advancement path A of the tray 1 and of the associated products P contained in it. The apparatus 300 comprises at least one station 302 supplying at least one base film or sheet 303; the sheet or film 303 exhibits one first and one second prevalent development surfaces defining the length and width of the film and delimiting the thickness of the same. The attached figures illustrate a non-limiting embodiment of the invention wherein the supplying station 302 comprises a reel 302*a* of said sheet 303; the reel 302*a* is configured for unwinding in length the base sheet 303 along the advancement direction A (see FIGS. 14 and 19).

The apparatus 300 comprises a forming station 304 supported by the fixed frame 301 and placed downstream the supplying station 302 with respect to the advancement direction A: the sheet 303 from the station 302 enters the forming station 304. The forming station 304 is configured for receiving the base film or sheet 303 from the supplying station 302, and for forming by it the tray or precursor body 400 with tray-shaped elements (elements comprising at least the base 2 and lateral wall 3 of the tray 1). FIG. 14 illustrates in a non-limiting way a shape embodying the station 304 configured for defining, at each forming cycle, a plurality of tray-shaped elements (a number of elements comprised between 2 and 8, for example). However, it is not excluded the possibility of using the forming station 304 configured for defining, at each forming cycle, a single tray-shaped element 1.

The forming station 304 is substantially formed by at least one upper portion 305 and at least one lower portion 306 coupled and movable with respect to each other between an open position (FIG. 19) and a closed position (FIG. 14). In the open position, the upper portion 305 and lower portion 306 are spaced from each other and enable a longitudinal segment of the base film 303 to enter the forming station 304; in the closed position of the forming station 304, the upper portion 305 and lower portion 306 are adjacent to each other in order to stop the longitudinal segment of the base film 303 with respect to the forming station and for forming in such longitudinal segment the tray-shaped element 1 (at least the base 2 and lateral wall 3 of the element defining then the single tray 1 are defined in such station).

As it is visible in FIGS. 14 and 19, the forming station 304 comprises an activation system 307 configured for placing the lower and upper portions in the open and closed position. In a non-limiting way, the activation system 307 can comprise an actuator, for example a hydraulic or pneumatic actuator, configured for engaging both portions 305, 306 and moving them towards and away from each other for respectively defining the closed and open positions. The attached figures illustrate, in a non-limiting way, a configuration wherein the activation system 307 comprises two independent actuators respectively acting on the lower portions 306 and upper portion 305; in such configuration, the independent actuators are engaged, on one side, with the frame 301, while, on the other side, with the respective portion 305, 306. Each portion 305, 306 is therefore movable with respect to a fixed frame 301 in order to promote the access of the longitudinal segment of the base film or sheet 301 into the forming station 304.

As it is still visible in FIGS. 14 and 19, the apparatus 303 further comprises a station 308 supplying the products P, preferably engaged (supported) with the fixed frame 301, placed downstream the forming station 304 with respect to the advancement direction A of the base film or sheet 303. De facto, the supplying station 308 is configured for inserting one or more products P in the tray-shaped precursor body 400 or directly in the tray 1. As an alternative, loading the products P can be manual without any supplying station.

As it is visible in FIGS. 14 and 19, the apparatus 300 can further comprise at least one cutting unit 309 supported by the frame 301 and disposed downstream the station 308 supplying the products, with respect to the advancement direction A; the cutting unit 309 is configured for transversally and/or longitudinally separating (cutting) the precursor body 400 for defining single trays 1 or distinct units of the tray-shaped elements.

As hereinbefore described, the tray 1 can be made of plastic material and/or paper material. FIG. 14 schematically illustrates a first embodiment of the apparatus 300 for thermoforming trays of plastic material.

In such first embodiment, the sheet 303 from the reel 302 is a film completely made of plastic material. In such configuration, the forming station 304 can comprise, for example, a vacuum forming mould wherein the lower portion 306 comprises one or more cavities 306*a* reproducing the shape of the tray 1. The upper portion 305 of the forming station 304 is configured for cooperating with the lower portion 306 for defining a tightly closed mould; in this case, the tray shape is defined only on the lower portion 306. Still referring to the first embodiment of the apparatus 300, the forming station 304 can operate with a vacuum-moulding system wherein the lower portion 306 comprises one or more channels configured for establishing a fluid communication with the forming cavities 306*a* by one or more vacuum pumps; operating the pump enables to adhere the base film 303 to the cavities 306 and then forming said precursor body with one or more tray-shaped elements. Using the same mould configuration (the lower portion 306 exhibits one or more cavities while the upper portion 305 defines only a closure element), makes possible providing the upper portion 305 with a thrust pump enabling to adhere the base film 303 to the shape of the lower portion 306 (this configuration is not illustrated in the attached figures).

In a further embodiment variant of the forming station 304, the same can comprise a die-punch mould; in this case, the die is provided with one or more cavities 306 adapted to receive an external surface of the precursor body while the punch exhibits one or more projections countershaped to the cavities 306 of the die, adapted to thrust and deform the base film 303 inside the die in order to shape the precursor body 400 with one or more tray-shaped elements (the number of shaped elements depends on the number of cavities and projections of the mould).

As a further alternative, the forming station 304 can combine types of mould as hereinbefore described; particularly, the forming station 304 can comprise a die-punch mould comprising also a pump for vacuum-forming and/or a thrust pump.

Still referring to the first embodiment of the apparatus 300, the same can comprise an engraving station 310 configured for defining on a portion of the lateral wall 3 of the one or more tray-shaped elements, a cut 11 and/or a weakening line 12 for defining said trays. De facto, the engraving station 310 can be placed upstream the cutting station 309 as illustrated in FIGS. 14-16 so that the station 310 acts on the precursor body; FIGS. 14-16 illustrate a non-limiting embodiment of the apparatus 300 wherein the engraving station 310 is placed downstream the forming station 304 with reference to the advancement direction A of the precursor body 400.

Figure 17:
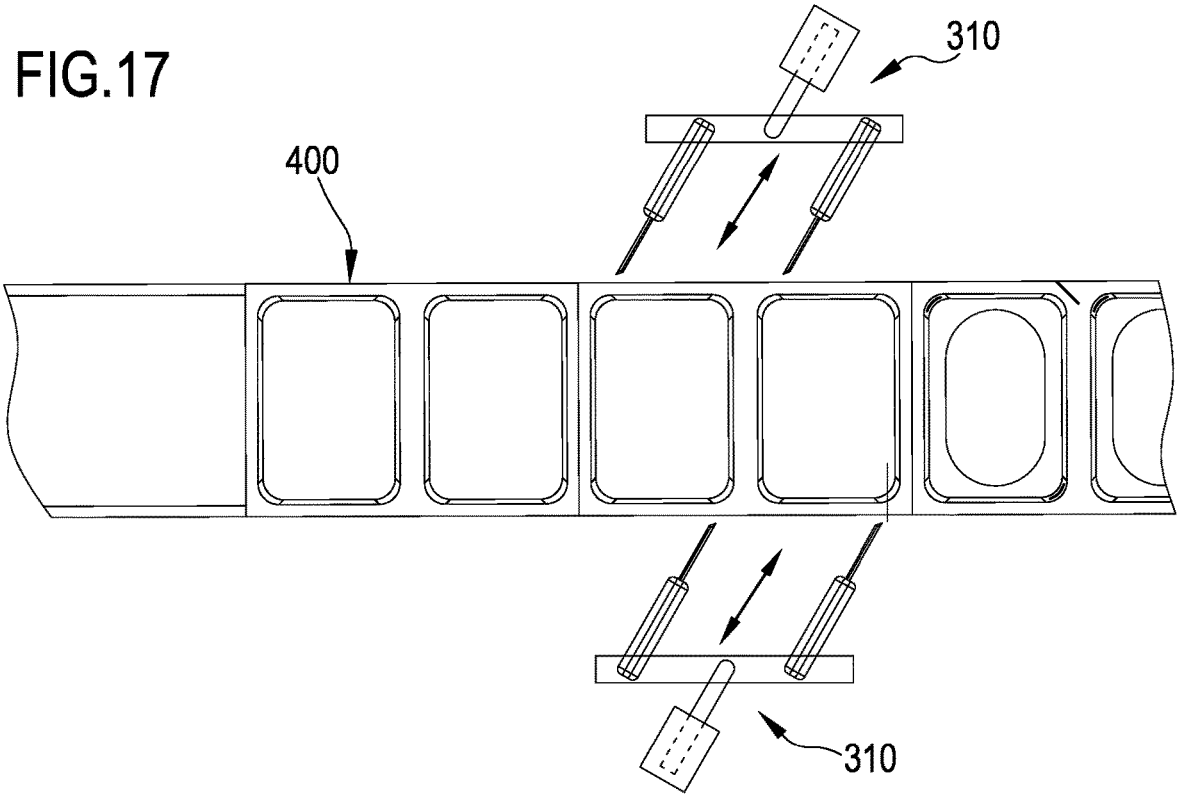

As it is visible in FIGS. 15-18 for example, the engraving station 310 comprises one or more knives configured for moving transversally to the advancement direction of the precursor body 400, and for engraving (cutting) the lateral wall 3 of the tray-shaped elements in order to define the cut 11 or weakening line 12 of the tray 1. FIGS. 15 and 16 illustrate a non-limiting embodiment of the engraving station 310, comprising a pair of knives configured for acting on one side of the precursor body 400 and particularly simultaneously, on two immediately consecutive tray-shaped elements. FIGS. 17 and 18 illustrate an embodiment variant wherein the engraving station comprises two pairs of knives placed on respective opposite sides of the precursor body. Each pair of knives is configured for acting on one side of the precursor body 400, and particularly simultaneously on two immediately consecutive tray-shaped elements. However, it is not excluded the possibility of providing an engraving station placed downstream the cutting station and configured for forming the cut 11 or weakening line 12 on the single tray-shaped elements.

On the contrary, FIG. 19 schematically illustrates a second embodiment of the apparatus 300 for making trays 1 of paper material. In such second embodiment, the sheet 303 from the reel 302*a* is a sheet completely made of paper material.

The apparatus, in the second embodiment thereof, comprises immediately downstream the supplying station 302, a die-cutter configured for cutting the sheet for defining the semifinished product 101 (see FIG. 20, for example). The die-cutter 311, besides enabling to perimetrally cut the sheet 303, is further configured for forming on the perimetral element 103 of the semifinished product 101, at least one cut 107 and/or at least one weakening line 108 adapted to respectively define the cut 11 and weakening line 12 of the tray 1. Immediately downstream the die-cutter 311, the apparatus 300—in the second embodiment thereof—comprises the forming station 304. In such configuration, the forming station 304 advantageously comprises a die-punch mould; in this case, the die is provided with one or more cavities 306 adapted to receive an external surface of the semifinished product 101, while the punch exhibits one or more projections countershaped to the cavities 306 of the die, adapted to thrust and deform the semifinished product 101 inside the die in order to define the tray (the number of obtainable trays depends on the number of cavities and projections of the mould). Downstream the forming station 304, the apparatus 300—in the second embodiment thereof—can comprise the product supplying station 308 (for example placed in-line), which is configured for housing one or more products inside the tray 1.

Package

Moreover, it is an object of the present invention a package 200 comprising a tray 1 according to anyone of the attached claims. The package 200 comprises at least one product P housed in the containing seat of the tray and particularly abutting on the base 2. FIG. 12 illustrates a package 200 comprising a single product P housed in the tray 1; obviously, the possibility of making a package comprising a plurality of products, for example of a food-type, is not excluded.

In addition, the package 200 comprises a film or skin 201 of plastic material engaged to the tray 1 for defining, cooperatively with this latter, a closed volume inside which the product P is received.

More particularly, the film 201 comprises at least one first portion contacting the product P, and at least one second portion fluid-tightly engaged to an internal surface of the lateral wall 3 of the tray 1 not contacting the product: the film 201, cooperatively with the tray 1, defines a fluid-tight closed volume inside which the product P is housed. In practice, the film intimately adheres substantially to the most part of the exposed surface of the product and is heat sealed at least to a part of the surface of the tray not contacting the product, in order to form a vacuum package of the "vacuum skin" type.

Still more particularly, the film 201 of the package 200 coats the internal surface of the lateral wall 3 of the tray 1 from the free edge 4 to a predetermined distance of said edge 4 greater than the maximum distance between the movable portion 7 and free edge 4. The film 201 defines, cooperatively with the tray wall, a closed outline portion extending all around the product P: such closed outline portion is disposed between the movable portion 7 and base 2 of tray 1. In a preferred embodiment, the film 201 is configured for defining around the movable portion 7, particularly around the movable portion 7, a fluid-tight closure: in other words, the film 201 fluid-tightly closes the product on the tray by fluid-tightly sealing the area of the movable portion 7.

FIGS. 12 and 13 illustrate the tray 1 with a movable portion 7 disposed in the first stable position wherein the portion itself does not define any access 8 passing through the lateral wall 3; the film 201 is stably welded to the lateral wall 3 of the tray and to the movable portion 7 placed in the first stable position.

Packaging Apparatus

In addition, it is an object of the present invention an apparatus 500 for packaging products P housed inside a tray 1 according to one or more of the attached claims.

The apparatus 500 comprises a packaging station 8 configured for receiving the tray 1 or, as an alternative, the precursor body 400. The attached figures illustrate an embodiment wherein the packaging apparatus 500 is separated and distinct from the apparatus 300 dedicated to make the tray 1. In such configuration, it is provided a moving system 210 for one of the two apparatuses, adapted to withdraw the trays 1 (alternately the single tray-shaped elements) and place them on a conveying member 209, for example a conveyor belt 209, of the packaging apparatus 500 (see FIG. 21). However, it is not excluded the possibility to integrate an apparatus 300 for making the tray with the packaging apparatus 500 in order to obtain a single apparatus configured for making trays and directly packaging the products: in this way, the trays and associated products would be continuously or step-by-step moved along a same manufacturing line.

The packaging station 203 is configured for receiving, besides the tray 1 with the associated product, at least one portion 204*a* of a closing film 204, for example from a source, such as a reel 205, of said closing film. The packaging station 203 is configured for fixing the portion 204*a* of the closing film to the tray 1 for obtaining the package 200.

The packaging station 203 is substantially dedicated to stably fix the portion 204*a* of the film 204—both as a continuous film and discrete sheets separated from each other—to the tray 1. Actually FIGS. 21 and 22 illustrate an embodiment of the apparatus 500 comprising a cutting station 211 placed outside the packaging station 203 and which is adapted to cut the film 204 for defining said discrete portions 204*a*. In such configuration, the apparatus 500 is provided with at least one system 212 transporting the film portion 204*a*: the transporting system 212 is configured for receiving and stably constraining the portion 201 and then for taking said portion inside the packaging station 203, above a respective tray.

On the contrary, FIG. 23 illustrates an apparatus 500 configured for enabling to insert a continuous film inside the packaging station 203: under such condition, the packaging station 203 is provided—in a known way—with a cutting tool configured for cutting, inside the station 203, the film for defining the portion 204*a* to be constrained to the tray 1 (this configuration is not illustrated in the attached figures).

The packaging station 203 comprises a lower tool 208 defining a predetermined number of seats, each destined to receive at least one tray 1 (as an alternative, a tray-shaped element). The packaging station 203 comprises also an upper tool 207 facing the lower tool 208 and configured for cooperating with this latter in order to define a fluid-tight chamber. The upper tool 207 preferably comprises a welding structure 215 adapted to act on the portion 204*a* of film 204, overlapped on the flange 15 of the tray 1.

According to the embodiments, the welding structure 215 can comprise a single heating body suitably temperature controlled or a heating element comprising one or more welding bars, operating perimetrally to an insert. In any case, the single heating body, in other words the welding bars and the associated insert, are activated and moved with respect to the lower tool 208 so that, when the packaging station 203 is in a closed condition, the heating surface of the welding structure 215 acts on the portion 204*a* of film 204, overlapped on the flange 15 of the tray 1, for heat sealing the portion 204*a* to the flange 15, and on the central part of the film for imparting to this latter the desired deformability required to conform the film to the product and adhere it to the internal surface of the tray lateral wall without a flange and therefore the tight closure could only rely on heat sealing the film portion 214 to the internal surface of the lateral wall not contacting the product. Once the film is tightly heat sealed to the tray, and possibly to the flange of this latter, such film implements a fluid-tight closure tightly insulating the product from the outside, by tightly closing the product on the tray and by fluid-tightly sealing the area of interest of the movable portion 7, defining in this way said film 201 of the package 200. More particularly, the insert of the heating structure, in other words the single heating body, suitably temperature controlled, exhibits a respective central surface operatively configured for being placed above the portion 204*a* of film 204 and for imparting to this latter a determined thermal level (heating of the portion 204*a* of film 204). Advantageously, the welding structure is configured for acting as a body holding the portion 204*a* (for example when the portions 204*a* are supplied to the packaging station 203 as pre-cut discrete films) and in this case, is provided with gripping means comprising for example a plurality of holes facing the lower surface of the insert or of the single heating body (see FIGS. from 24 to 30, for example), and connected to a suctioning system 216 for example managed by a control unit 600 which will be fully described in the following. The suctioning system is configured for holding the portion 204*a* by suctioning air from the holes of the insert or of the single heating body.

By the cooperation between the lower tool 208 and upper tool 207, the portion 204*a* of film 204 is held exactly above the respective tray for therefore enabling to heat couple each portion 204*a* to the associated tray 1.

As illustrated in FIGS. from 24 to 30, the packaging station 203 is connected to a suctioning group 213 capable of providing a partial vacuum condition in the fluid-tight chamber.

Figure 24:
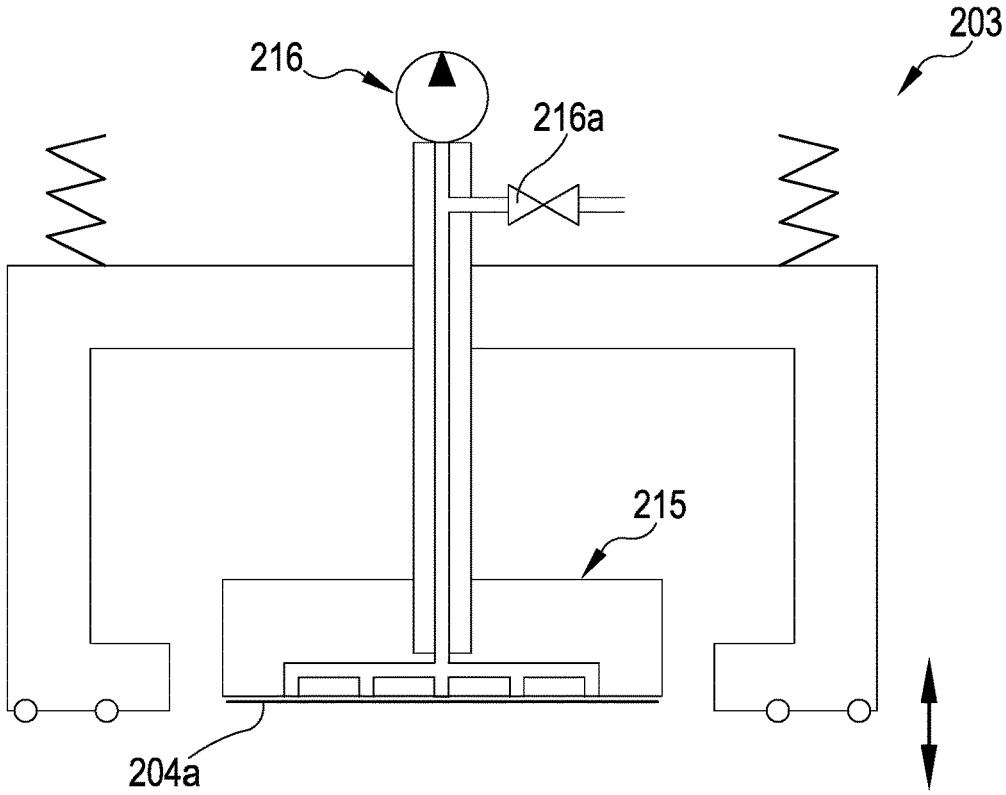
Figure 24:
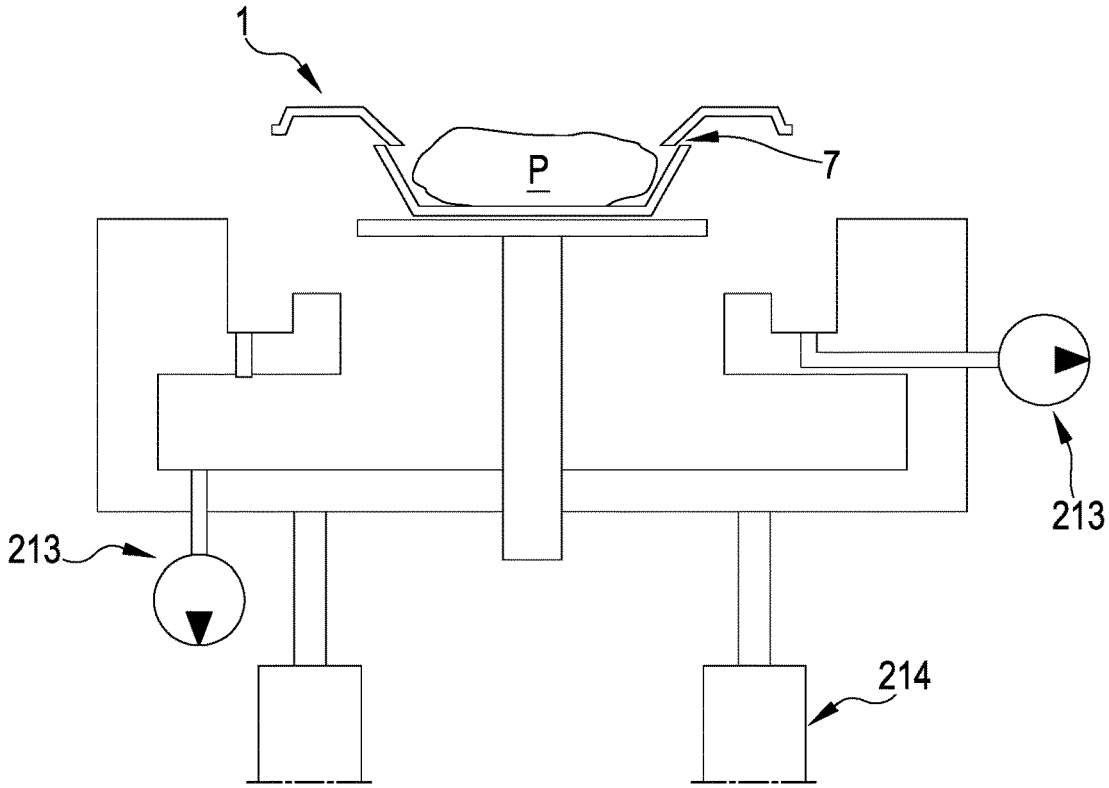
Figure 25:
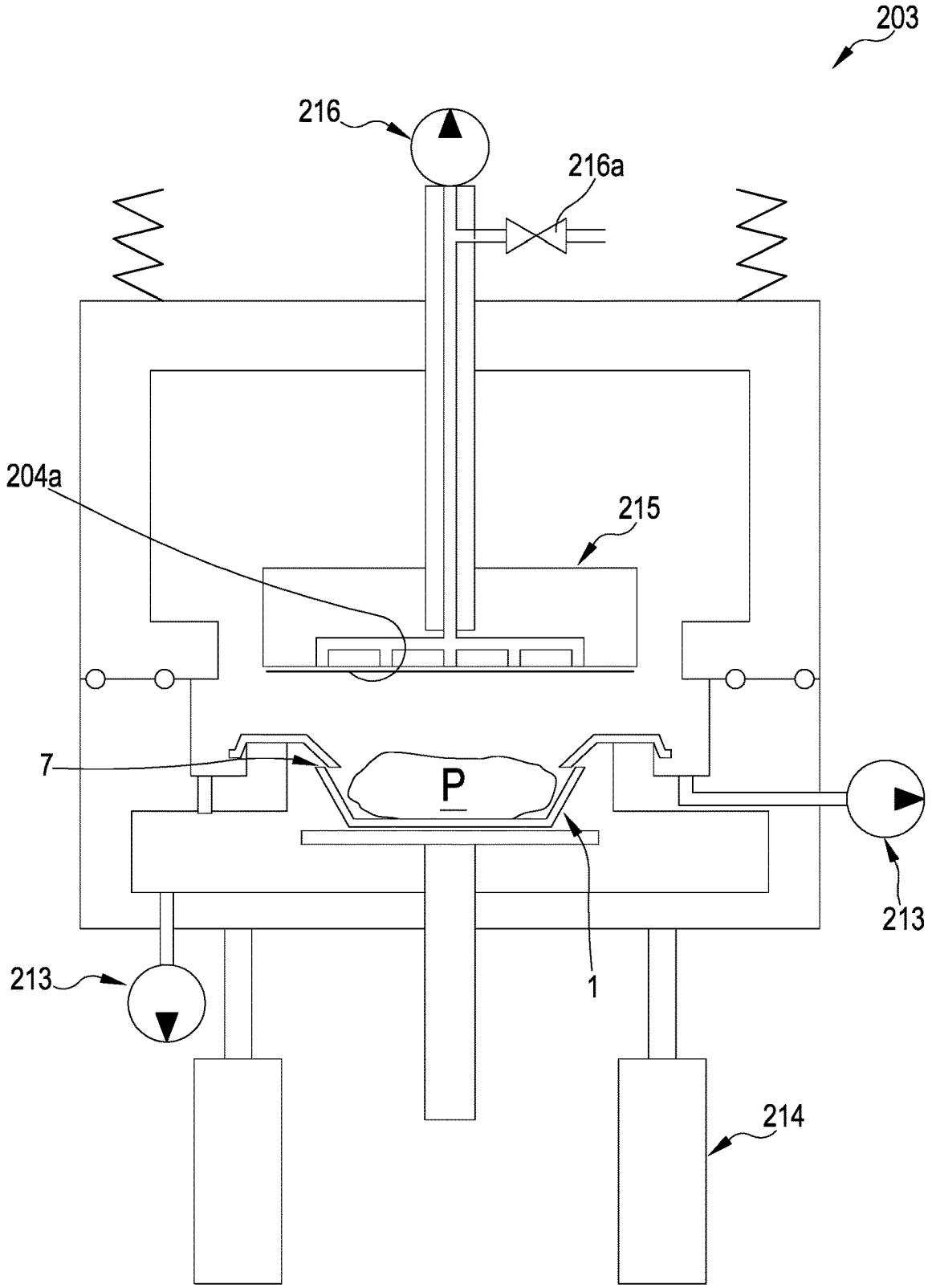
Figure 26:
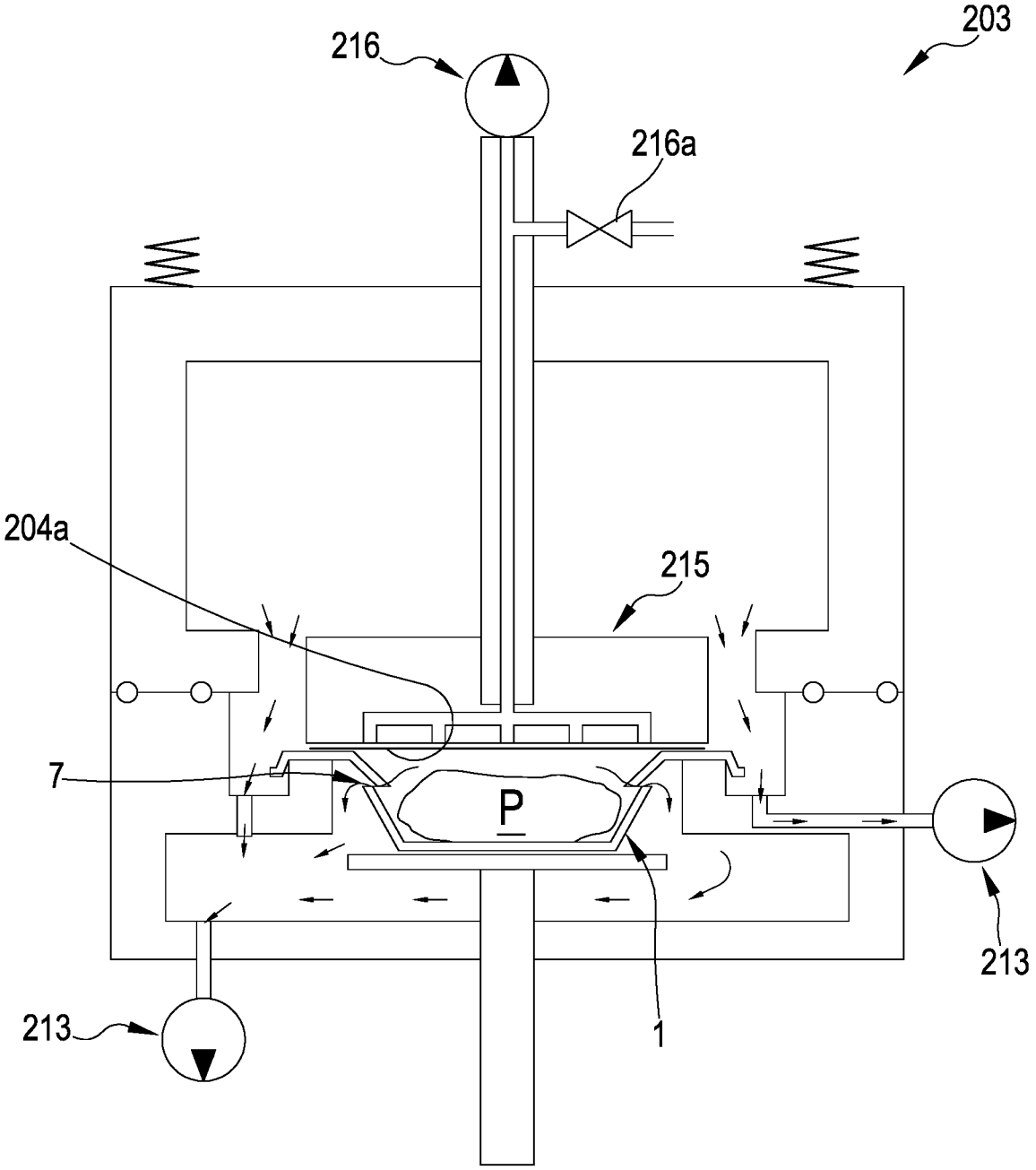
Figure 27:
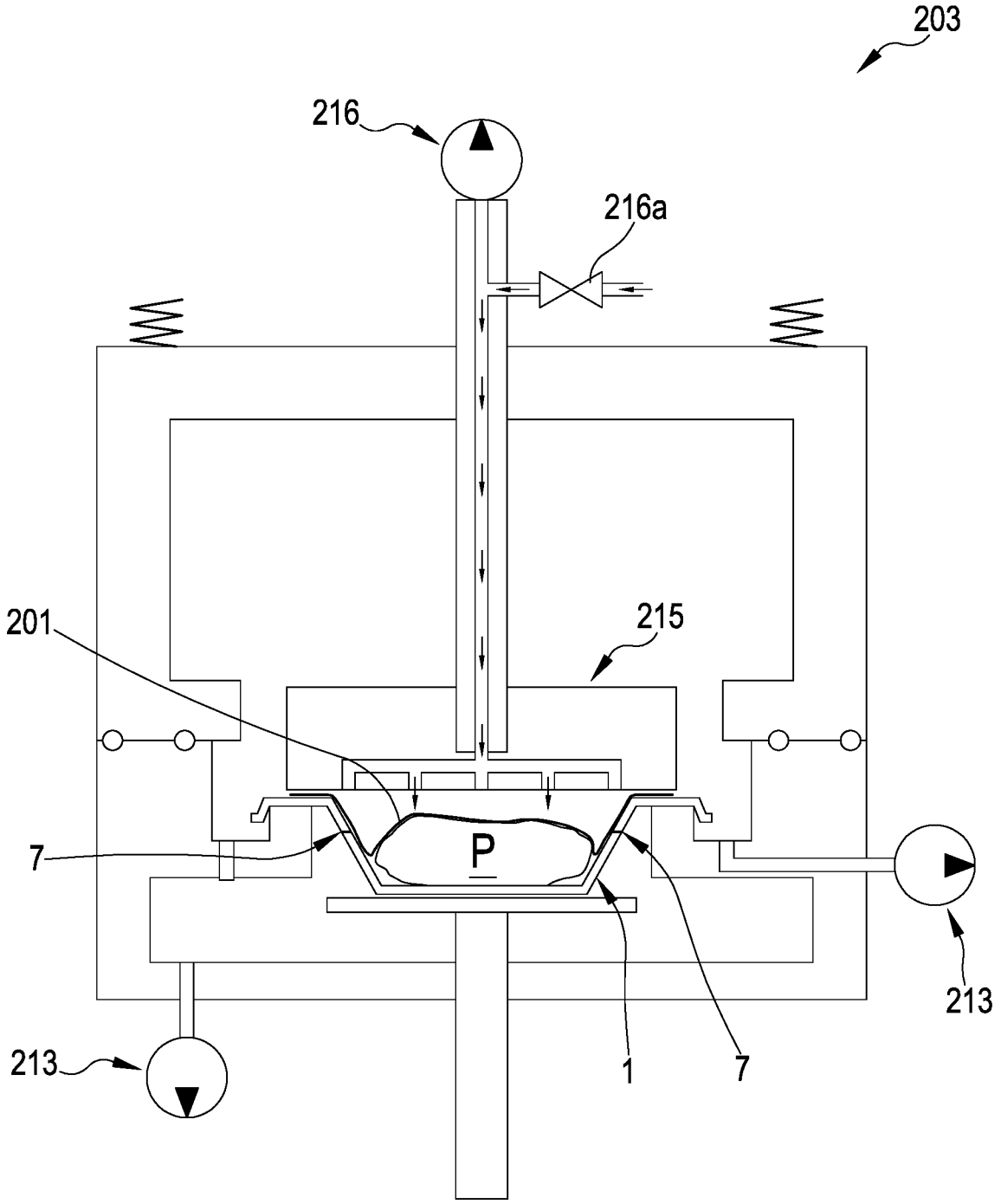

Still more particularly, the upper tool 207 and lower tool 208 are movable with respect to each other between an open condition and closed condition. In the open condition of the packaging station 203, the upper tool 207 and lower tool 208 are spaced from each other and enable to position one or more trays 1 in the seats of the lower tool and to position said portion 204*a* of the closing film above one or more associated trays 1 (this condition is illustrated in FIG. 24). In the closed condition of the packaging station 203, the upper tool 207 and lower tool 208 are juxtaposed to each other in order to stop or stably position the one or more trays 1 with respect to the packaging station 203 and to fix the film closing portion 204*a* to the one or more associated trays 1 for defining the film 201 of the package 200.

As it is visible in FIGS. 24-30, for example, the packaging station 203 comprises an activation system 214 configured for disposing the upper and lower tools in the open and closed conditions. In a non-limiting way, the activation system can comprise an actuator, for example a hydraulic or pneumatic actuator, configured for engaging both the tools and moving them towards and away from each other for defining respectively the closed and open conditions. The attached figures illustrate, in a non-limiting way, a configuration wherein the activation system comprises two actuators acting on the lower tool 208 and a pair of elastic elements active on the upper tool 207.

As hereinbefore briefly described, the apparatus 500 can comprise a control unit 600; such unit is advantageously connected to the member 209 transporting the trays, to the reel 205 for unwinding the closing film 204, to the cutting station 211 of the film 204 and to the packaging station 203. Particularly, the control unit 600 is configured for synchronizing the movement of the trays 1 on the conveying element 209 with the unwinding operating of the reel 205 and with the possible cutting station, so that the cutting station can correctly supply a film portion 204*a* for each tray 1. Particularly, the control unit 600 is connected to the activation system of the packaging station 203, for managing the open/closed positions. Advantageously, the control unit 600 is configured for synchronizing the activation system 214 so that the open position of the packaging station corresponds to a step of moving, inside the station 203 itself, at least one film portion 204*a* and at least one tray 1. Moreover, the control unit 600 is advantageously connected to the welding structure 215 of the packaging station and is configured for managing the thermal trend in order to be able to controllably heat the film portion. Moreover, the control unit is connected to the suctioning system 216 and is configured for commanding the activation of said system 216 for holding the portion 204*a*.

As it is visible in the attached figures, the apparatus 500 can further comprise a pusher 206 configured for thrustingly acting on the lateral wall 3 of the trays 1 (or on the lateral wall of the tray-shaped elements) in order to move the movable portion 7 of the trays from the first to the second stable positions. As illustrated in FIG. 21, the pusher 206 can comprise a type of handling element configured for withdrawing the trays and placing them on the conveying element 209 of the apparatus 500; in such configuration, the pusher 206 is configured for acting on the movable portion 7 during the step of raising and moving the tray 1 on the conveying element 209. FIG. 22 illustrates an embodiment variant of the apparatus, wherein the pusher 206 is associated to the conveying element 209; in such configuration, the pusher 206 is configured for acting on the trays 1 abutting—particularly by moving—on the element 209 along the advancement direction A.

FIGS. 39 and 30 illustrate a further embodiment variant of the apparatus 500 wherein the pusher 206 is associated to the packaging station 203 and particularly is disposed inside the fluid-tight chamber. In such configuration, the pusher 206 is configured for acting on the trays abutting on the lower tool 208 of the packaging station 203.

Advantageously, the control unit 600 is connected to the pusher 206 and is configured for commanding the movement and therefore the activation on the trays 1; de facto, the control unit 600 is configured for synchronizing the activation of the pusher 206 with the movement of the conveying element and with the operative steps of the packaging station 203. The pusher 206 can comprise a solid body only configured for moving the movable portion from the first to the second stable positions. FIGS. 29 and 30 illustrate an embodiment variant of the pusher 206 useable inside the packaging station 203; indeed, such pusher 206 can comprise at least one tubular body configured for moving the movable portion 7 from the first to the second stable positions and for connecting it to the suctioning group 213 of the packaging station, for forming a vacuum inside the tight chamber. The tubular pusher 206 is configured for being placed at the access 8 of the tray and for enabling—by the suctioning group—to remove, at least partially, the air present inside the tray.

The attached figures illustrate, in a non-limiting way, a configuration of the apparatus comprising a pusher 206 configured for acting on two opposite movable portions of a same tray 1. It is not excluded the possibility of providing a pusher 206 configured for acting on only one movable portion 7 of the tray 1 or on a number of portions 7 greater than two.

More particularly, the apparatus 500, according to the invention, uses at least one control unit 600 comprising a respective digital processor (CPU) with a memory (or memories), an analog-type circuit, or a combination of one or more digital processing units with one or more analog-type circuits. The control unit can be "configured" or "programmed" for executing some steps: this can be made substantially with any means enabling to configure or program the control unit 600. For example, in case of a control unit 600 comprising one or more CPUs and one or more memories, one or more programs can be stored in suitable memory banks connected to the CPU or CPUs; the program or programs contain instructions that, when executed by the CPU or CPUs, program or configure the control unit for executing the operations described with reference to the control unit. As an alternative, if the control unit comprises an analog-type circuitry, then the circuit of the control unit can be designed to include a circuitry configured, in use, for processing electric signals in order to execute the steps regarding the control unit.

Packaging Process

Moreover, it is an object of the present invention a process of packaging products P disposed in a tray 1 according to anyone of the attached claims.

The packaging process comprises a first step of withdrawing a tray 1 and moving the same for example by the conveying element 209 along an advancement direction A. The tray 1, containing the product P, is disposed inside the packaging station 203. The process can comprise a step of handling the tray 1 before the same is inserted into the packaging station 203; the handling step enables to move the movable portion 7 from the first to the second stable positions. As an alternative, the step of handling the tray can be performed following or during the positioning of the same inside the packaging station 203.

When the tray is positioned inside the packaging station 203, the process comprises a step of providing the portion 204*a* of the film 204, which—following the formation thereof—is introduced into the packaging station, particularly by engaging the upper tool 207. Particularly, the portion 204*a* is held, by suctioning air through the plurality of holes of the welding structure 215, with the system 216.

Then, the process comprises a step of tightly closing the packaging station 203 for defining inside it, the fluid-tight chamber wherein the tray 1 is housed.

After tightly closing the chamber of the packaging station 203, the process comprises a step of removing at least partially the air contained in the fluid-tight chamber in order to define inside the station 203 itself a pressure less than the atmospheric pressure.

Simultaneously or immediately after the step of removing air, the process comprises a step of heating the portion 204*a* of film 204 by the insert of the upper tool 207; the heating step can start also as the film portion 204*a* contacts the heating surface of the welding structure; the heating step enables to take the film portion 204*a* to a condition wherein the same is capable of deforming and to be welded to the tray 1.

After heating the film portion 204*a*, the process comprises at least one step of heat coupling, in the packaging station 203, the film portion 204*a* to the tray 1 in order to close the product inside the tray 1. In a first part of such step, the product is not already tightly closed inside the tray because the movable portion 7 of tray is disposed in the second position: the containing seat of the tray is in fluid communication with the fluid-tight chamber of the packaging station 203.

Simultaneously and/or after the step of heat coupling the film portion to the tray, the process continues to extract air from the fluid-tight chamber: under such condition, any air present inside the tray is removed through the access 8 defined by the movable portion 7 of the tray.

Then, the process comprises a step of releasing the film portion from the insert or from the single heating body, so that such portion can intimately contact the product and at least part of the internal surface of the tray 1. During such step, the film portion 204*a* defines a film of the package wherein the same tightly recloses the product into the package itself and tightly closed the access 8 of the tray 1.

The step of releasing the film portion 204*a* can be for example started by supplying a predetermined amount of air to the plurality of holes of the welding structure of the packaging station, so that between the heating surface and film portion 204*a* a pressure greater than the one present inside the fluid-tight chamber is generated: such pressure differential causes the portion 204*a* to be released and to be pushed on the product.

Figure 28:
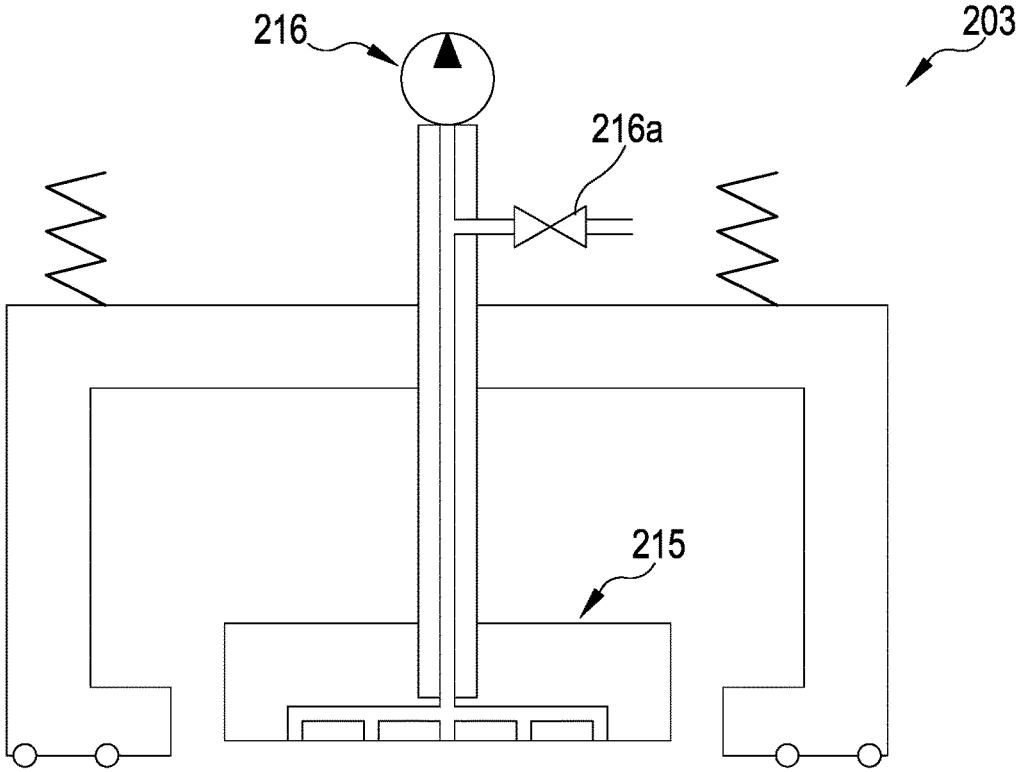
Figure 28:
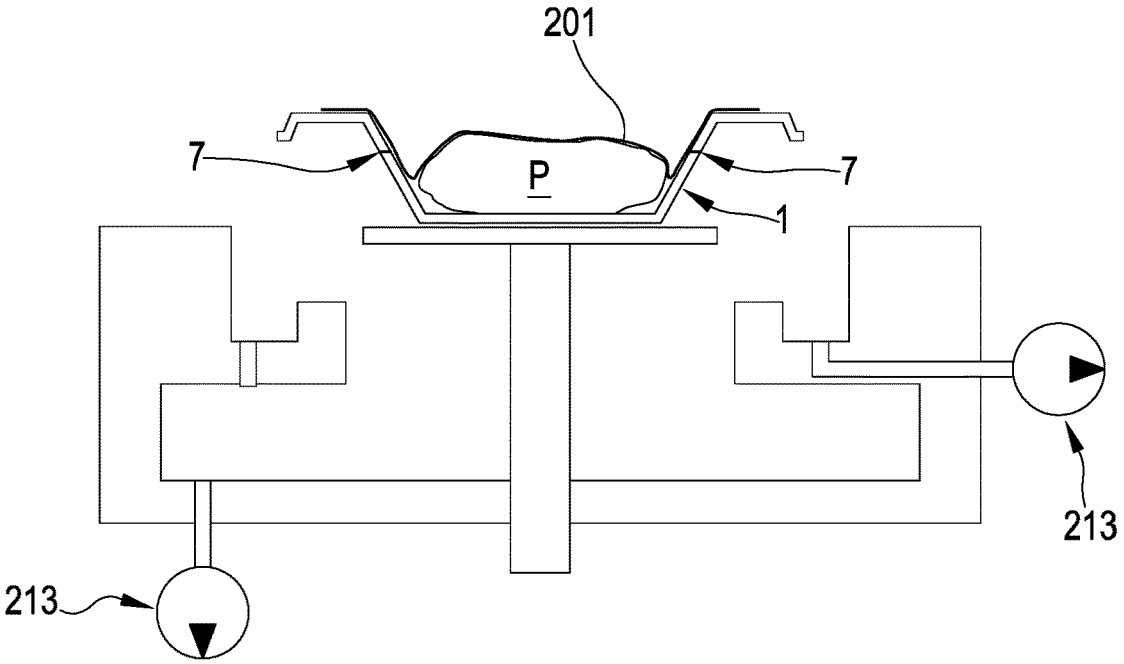

After completing the engagement of the film 201 on the tray, the access 8 is closed so that the product P is tightly housed between the tray 1 and the film portion 201 (see FIG. 28, for example). After such step, it is therefore possible commanding to open the packaging station 203 and move the package 200 outside said station 203.

The invention claimed is:

1. A package comprising:

at least one tray, the at least one tray comprising:

a base, and a lateral wall transversally emerging from the base to define a containing seat adapted to receive the product, the lateral wall being delimited by a free edge opposite with respect to the base and defining an opening of the tray, wherein the lateral wall comprises at least one movable portion configurable between:

at least one first stable position, and at least one second stable position wherein the movable portion protrudes from the lateral wall and defines an access passing through the lateral wall itself;

at least one product received in the containing seat of the tray; and at least one plastic film having a first portion in contact with the product, and a second portion fluid-tightly engaged with an internal surface of the lateral wall of the tray not in contact with the product, the film cooperatively with the tray defining a fluid-tight closed volume, inside which the product is housed.

2. The package of claim 1, wherein:

the plastic film completely covers the movable portion of the tray, the plastic film being configured to define around the movable portion, the second portion is fluid-tightly engaged with an internal surface of the lateral wall of the tray not in contact with the product forms a sealing band completely surrounding the product and tightly insulating the product from the movable portion.

3. The package of claim 1, wherein the movable portion of the tray is placed in the first stable position.

4. The package of claim 1, wherein the lateral wall comprises one or more of:

an angular portion exhibiting a concavity facing the containing seat of the tray, or a curved portion exhibiting a concavity facing the containing seat of the tray, wherein the movable portion is defined at the angular portion and/or the curved portion.

5. The package of claim 4, wherein the movable portion is a foldable portion configurable between:

the first stable position wherein the foldable portion is placed in continuity with the angular portion and/or the curved portion of the lateral wall, the second stable position wherein the foldable portion protrudes from the angular portion and/or the curved portion of the lateral wall inside the containing seat of the tray.

6. The package of claim 4, wherein the access is delimited by at least one free edge of the movable portion and by at least one intermediate edge of the lateral wall, and wherein the lateral wall comprises, at the angular portion and/or curved portion, at least one cut or one weakening line configured to promote the formation, in the second stable position of the movable portion, of the free edge of the movable portion and of the intermediate edge of the lateral wall.

7. The package of claim 1, wherein the movable portion comprises at least one tab hinged to the lateral wall by at least one folding line, the tab being rotatively movable with respect to the lateral wall around the folding line.

8. The package of claim 1, wherein:

the movable portion comprises a first tab connected to a side of the angular portion by means of a first folding line, the movable portion, further comprises a second tab connected to another side of the same angular portion by means of a second folding line, the first and second tabs are connected to each other by means of an intermediate folding line.

9. The package of claim 8, wherein the first folding line, second folding line and intermediate folding line intersect at a point of a corner of the angular portion itself.

10. The package of claim 1, further comprising at least one main layer made of at least one selected in the group of the following materials: paper, paperboard, plastic.

* * * * *